US008038582B2

(12) United States Patent
Edmondson

(10) Patent No.: US 8,038,582 B2
(45) Date of Patent: Oct. 18, 2011

(54) ARTICULATED HANDLES FOR ROWING EXERCISE DEVICES

(76) Inventor: Robert Edmondson, Peterborough (CA)

( * ) Notice: Subject to any disclaimer, the term of this patent is extended or adjusted under 35 U.S.C. 154(b) by 0 days.

(21) Appl. No.: 12/499,501

(22) Filed: Jul. 8, 2009

(65) Prior Publication Data

US 2010/0009816 A1 Jan. 14, 2010

Related U.S. Application Data

(60) Provisional application No. 61/079,985, filed on Jul. 11, 2008, provisional application No. 61/149,137, filed on Feb. 2, 2009.

(51) Int. Cl.
*A63B 69/06* (2006.01)

(52) U.S. Cl. ..... 482/72

(58) Field of Classification Search ..... 482/72–73, 482/139, 97–101, 135–138
See application file for complete search history.

(56) References Cited

U.S. PATENT DOCUMENTS

| | | | | |
|---|---|---|---|---|
| 4,743,011 | A | 5/1988 | Coffey | 482/73 |
| 4,884,800 | A * | 12/1989 | Duke | 482/73 |
| 6,561,960 | B2 * | 5/2003 | Webber | 482/138 |
| 6,830,542 | B2 * | 12/2004 | Ball et al. | 482/72 |
| 7,270,630 | B1 | 9/2007 | Patterson | 482/121 |

* cited by examiner

*Primary Examiner* — Fenn Mathew
(74) *Attorney, Agent, or Firm* — Teitelbaum & MacLean; Neil Teitelbaum; Doug MacLean

(57) ABSTRACT

A handle for an exercise machine, e.g. a rowing machine, which is mounted on an end of a connecting linkage, e.g. chain, strap or cord, which extends along an axis of force application in the exercise machine. The handle includes first and second arm structures pivotally connected at their ends to a mounting bracket, which is attached to the connecting linkage. Handgrips are mounted on an the outer free ends of the first and second arm structures for pulling towards the users body, while separating the first and second arms apart, thereby replicating actual rowing strokes. Preferably, the handle is adjustable to various positions to replicate various rowing styles, e.g. conventional or crossover.

14 Claims, 25 Drawing Sheets

TRANSITION BETWEEN CONFIGURATIONS

CROSSOVER CONFIGURATION

- ROWER'S VIEW OF ONE SIDE
- HANDLE ASSY REMOVED FOR CLARITY

STANDARD CONFIGURATION

ARTICULATED HANDLES FOR ROWING EXERCISE DEVICES

CROSS-REFERENCE TO RELATED APPLICATIONS

The present invention claims priority from U.S. Patent Applications Nos. 61/079,985 filed Jul. 11, 2008 and 61/149,137 filed Feb. 2, 2009, which are incorporated herein by reference for all purposes.

TECHNICAL FIELD

The present invention relates to handles for a rowing exercise device, and in particular to articulated handles, which can be selectively configured to enable the user to replicate different styles of rowing.

BACKGROUND OF THE INVENTION

Exercise devices, which simulate rowing, of the type utilizing rotational inertia, e.g. from a solid or a liquid flywheel, offer a greatly improved replication of the resistance of actual rowing in comparison to rowing exercise devices which utilize hydraulic pistons, elastic cords, springs, or weights as sources of resistance. Unfortunately, although the flywheel-equipped devices provide an improved feel to the resistance, that improvement is considerably diminished by deficiencies in the design of the handles commonly used with these devices.

In a typical arrangement, the user grasps a rigid, single piece handle, which is fixed to a chain, cable, or strap at the handle's midpoint. The chain, cable or strap is passed about a sprocket or pulley, which, through a uni-directional roller clutch, is mechanically connected to the axle of the flywheel. The linear force the user applies to the handle during the power portion of the rowing stroke is thereby converted to rotational inertia of the flywheel. During the return (recovery) portion of the rowing stroke the chain slack is taken up by means of a suitable spring mechanism.

The use of a rigid, single piece handle severely restricts the physical action of the user, limiting the user's movement to an approximation of one type of rowing style, which would be similar to that used by a crewmember of a multi-person rowing shell, wherein each crew member grasps one oar with both hands.

However, proportionately few users of rowing exercise devices are competitive rowers seeking to improve their single oar technique. Most users of these devices do so for the general health benefits of the exercise these devices offer. Of those users who are competitive rowers, only a certain percentage of them would have an interest in the single oar rowing style. Many rowers use the sculling style of rowing, in which the rower uses two oars rather than one. The rigid, single-piece handle on a rowing exercise device forces these users to adopt a single oar rowing style which is of limited benefit to them. Clearly, a handle design which offers an increased range of movement, improved ergonomics, and which also allows the user to replicate single and double oar rowing styles, would be of obvious benefit to both the average user and the competitive rower.

There have been limited attempts by others to design an improved handle for flywheel type rowing exercisers. For example: U.S. Pat. Nos. 4,743,011 issued May 10, 1988 in the name of Coffey; and 7,270,630 issued Sep. 18, 2007 in the name of Patterson disclose conventional rowing machines attempting to duplicate sculling-style rowing.

U.S. Pat. No. 4,743,011 issued in 1988 to Calvin Coffey discloses a design of flywheel based rowing exercise device, which provides a somewhat accurate replication of a double oar rowing action by fitting the device with oar handles and shafts, oar locks, and mechanical means to convert the arcuate movement of the oars to rotational movement of the flywheel. However, the design is not intended as a retrofit of currently available rowing exercise devices, since the Coffey device requires major mechanical changes and reconfiguration of components, e.g. repositioning the flywheel from a forward to a rearward location.

U.S. Pat. No. 7,270,630 issued in 2007 to Paul Patterson, as part of a design for a rowing exercise device, discloses a handle design, which allows a greater range of movement than offered by the standard rigid single piece handle. However, due to the forward space requirements of the handle design, it also cannot be easily adapted to currently available rowing exercise devices.

The embodiments of the present invention enable replication of single and double oar rowing styles on a flywheel-type rowing device. Successful replication of the stroke geometry of actual rowing requires that the characteristics of that geometry be understood.

FIG. 1 illustrates a conventional oar/oarlock arrangement in which an oar 200 with an oar handgrip 201 is mounted in an oarlock 202 of a boat 203. Pulling on the oar handgrip 201 will cause the handgrip 201 to move through an arc, the radius of that arc being defined by the distance between the handgrip 201 and the oarlock 202.

At any moment in the progression of the rowing stroke, the rower can rotate the handgrip in any direction about the z-axis. Also, at any moment in the progression of the stroke, the rower can by raising or lowering the handgrip 201, cause the handgrip 201 to rotate in any direction about the x-axis. The magnitude and direction of these rower controller rotations about the z and x axes are independent of each other and are independent of the position of the handgrips in space with respect to the progression of the rowing stroke.

The magnitude and direction of rotation of the handgrip 201 about the third axis, i.e. the vertical y-axis, is entirely dependent on the stage of progression of the rowing stroke. Unlike rotation of the handgrip 201 about the z and x axes, the rotation of the handgrip 201 about the y-axis is fixed and immutable at any moment in the progression of the rowing stroke. To put it another way, if the rower were to stop at any stage in the progression of the rowing stroke, the rower would be able to rotate the handgrip 201 about the z and x axes, but would be unable to rotate the handgrip about the vertical y-axis. Rotation about the y-axis can only be effected by stroke progression.

It follows from these observations of the geometry of actual rowing, that replication of rowing, if it is to achieve satisfactorily realistic results, must retain independence of handgrip rotation about the z and x axes throughout the rowing stroke, and ensure that handgrip rotation about the vertical y-axis remains directly dependent on the horizontal progression of the rowing stroke.

Accordingly, using the geometry of actual rowing as a guide, any embodiment enabling replication of rowing must, whether replicating the "standard" style of rowing or the crossover style of rowing, ensure that the above-identified angular progression about the y-axis is a smooth, aberration free change directly proportional to the progression of the rowing stroke.

Although rower controlled handgrip rotation about the z-axis is a characteristic of actual rowing, in tests, its exclusion is not experienced as a defect. If desired however, handgrip rotation about the z-axis could easily be added to any of the disclosed embodiments.

Rower controlled handgrip rotation about the x-axis is restricted in actual rowing. In all of the disclosed embodiments, handgrip rotation about the x-axis is unrestricted, which enables the user to adopt hand positions unrelated to actual rowing, thereby greatly increasing the versatility of the rowing exercise device, but without affecting the fidelity of rowing replication, if the user chooses to exercise in various styles.

In actual rowing, at the beginning of the stroke, the handgrips of the oars are at a certain distance apart. As the stroke progresses, each of the handgrips move through an arc, reducing that initial separation, and then moving apart again as the handgrips continue to follow that arc to the end of the stroke. The functional characteristics of the disclosed embodiments do not include the handgrip separation at the beginning of the stroke. Like the lack of rotation about the z-axis of the handgrips, the lack of hand separation at the beginning of the stroke is not experienced as a defect, because it feels completely natural and ergonomically correct.

It was also determined that the required arc of movement to approximate the arc sweep of actual oars, was a natural outcome of the user's body mechanics and does not need to be mechanically dictated. Accordingly, two arms hinged at the front with handgrips mounted at a fixed angle on the ends of those arms would still produce a smooth angular progression of the handgrips as the handgrips followed the natural arc defined by the user's body mechanics, and as the hinged arms of the device spread during progression of the stroke.

An object of the present invention is to provide an accurate replication of the rowing motion, by providing a rowing handle, which is more readily adaptable to currently available rowing exercise devices that have limited space requirements during use.

Another object of the present invention is to overcome the shortcomings of the prior art by enabling the user a greater range of movement than afforded by a single piece handle. The present invention enables the geometry of the user's movements to be ergonomically correct, following natural body mechanics and thus reducing the possibility of strain injury. Moreover, the present invention enables the user to replicate the physical movement of single and double oar rowing styles, or if the user wishes, to adopt stroke geometries unrelated to actual rowing, thereby bringing various muscle groups into play and thus broadening the usefulness and appeal of rowing exercise devices.

SUMMARY OF THE INVENTION

Accordingly, the present invention relates to a handle for mounting on an end of a connector, which extends along an axis of force application in a rowing exercise machine, comprising:

a mounting bracket for connecting the handle to the one end of the connector;

a first arm structure pivotally connected at one end to the mounting bracket;

a second arm structure pivotally connected at one end to the mounting bracket;

a first handgrip mounted on an outer free end of the first arm structure; and a second handgrip mounted on an outer free end of the second arm structure;

whereby the outer free ends of the first and second arms are pivotable apart as force is applied along the axis of force application.

BRIEF DESCRIPTION OF THE DRAWINGS

The invention will be described in greater detail with reference to the accompanying drawings which represent preferred embodiments thereof, wherein:

FIGS. 22*a* and 22*b* illustrate in sequenced images the positional changes of the handgrips and arms of the device when the user exercises using a sculling (crossover) style of rowing stroke.

DETAILED DESCRIPTION

Figure 1:
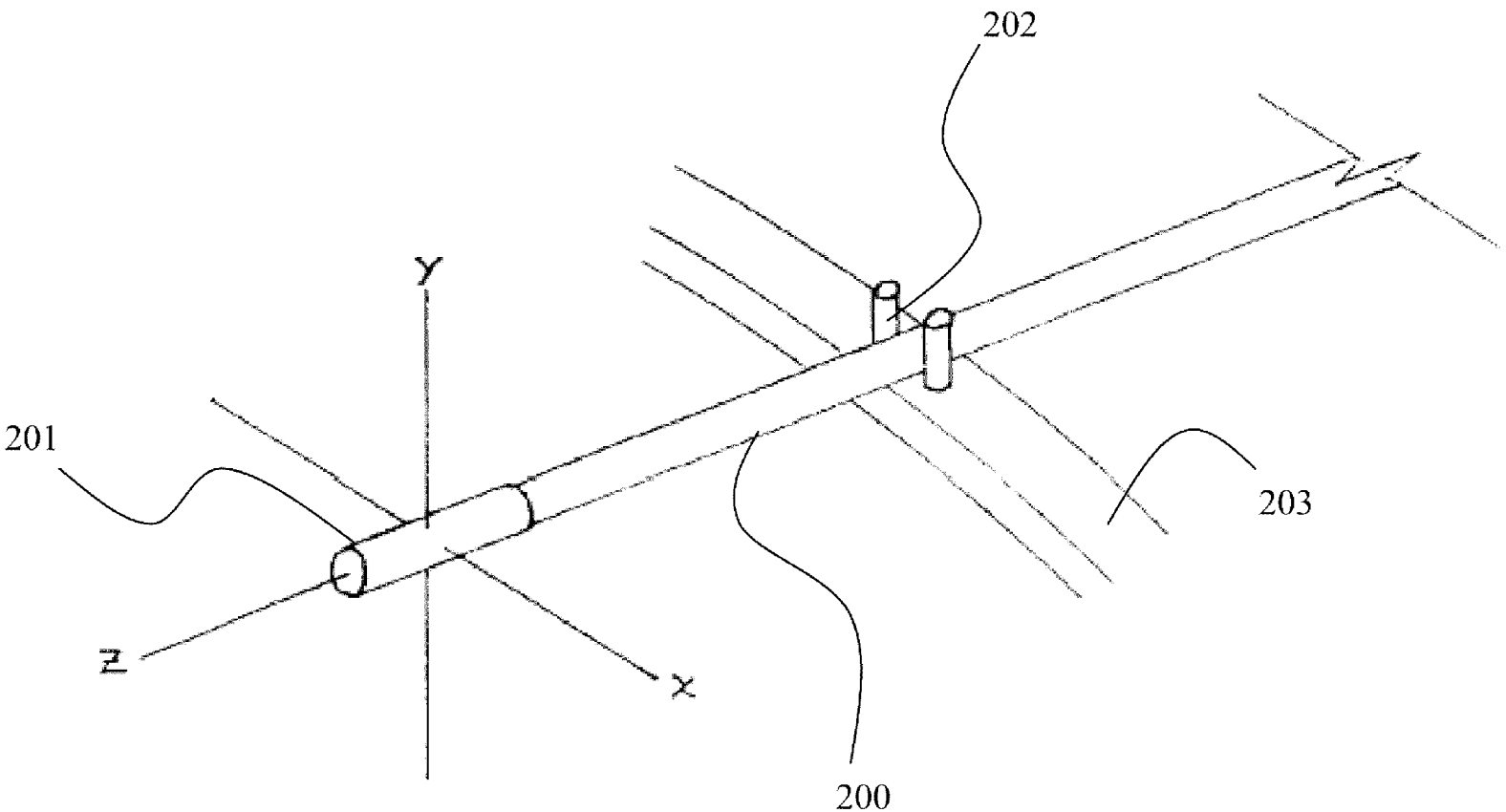
FIG. 1 illustrates a conventional oar/oarlock arrangement.
Figure 2A:
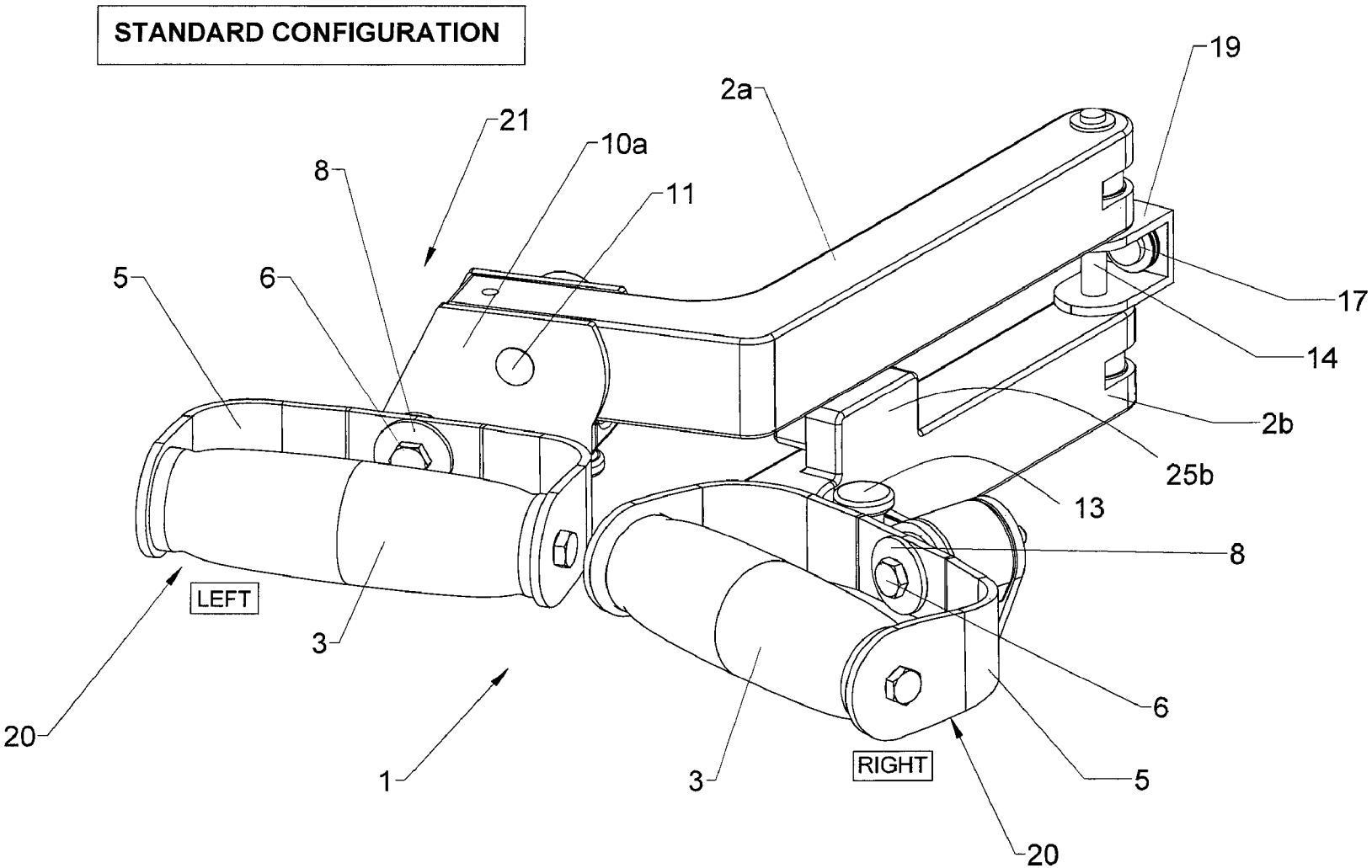
FIG. 2*a* is an isometric view of a rowing handle device in the standard configuration in accordance with the present invention.
Figure 2C:
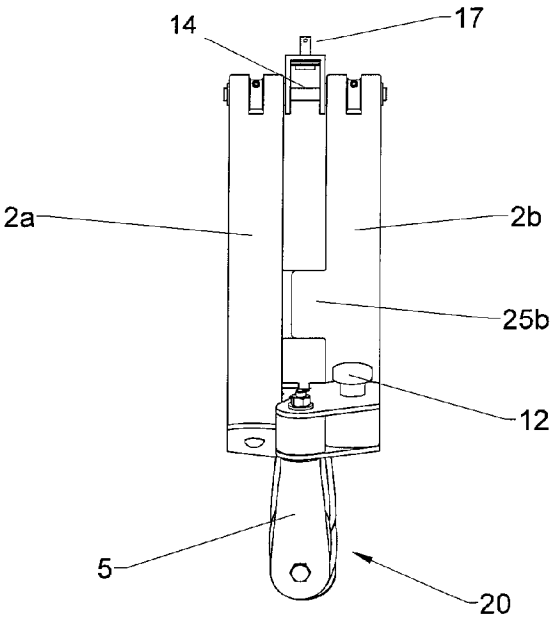
FIG. 2*c* is a side view of the rowing handle device of FIG. 2*a*
Figure 2B:
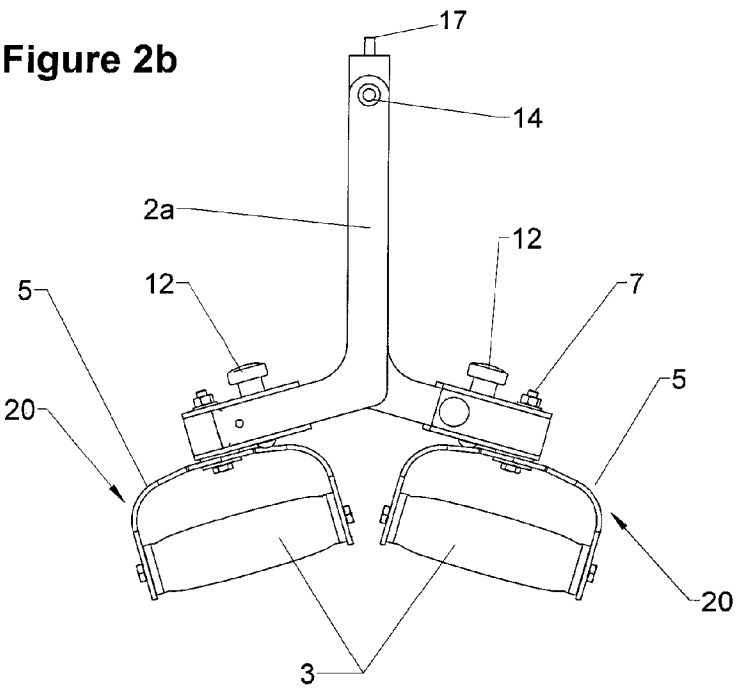
FIG. 2*b* is a top view of the rowing handle device of FIG. 2*a;*
Figure 2D:
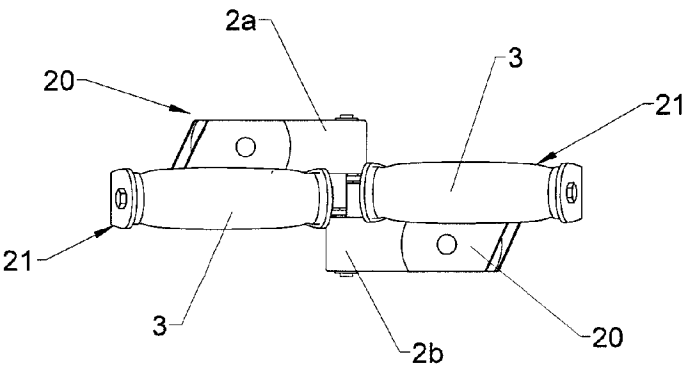
FIG. 2*d* is a front view of the rowing handle device of FIG. 2*a;*
Figure 3A:
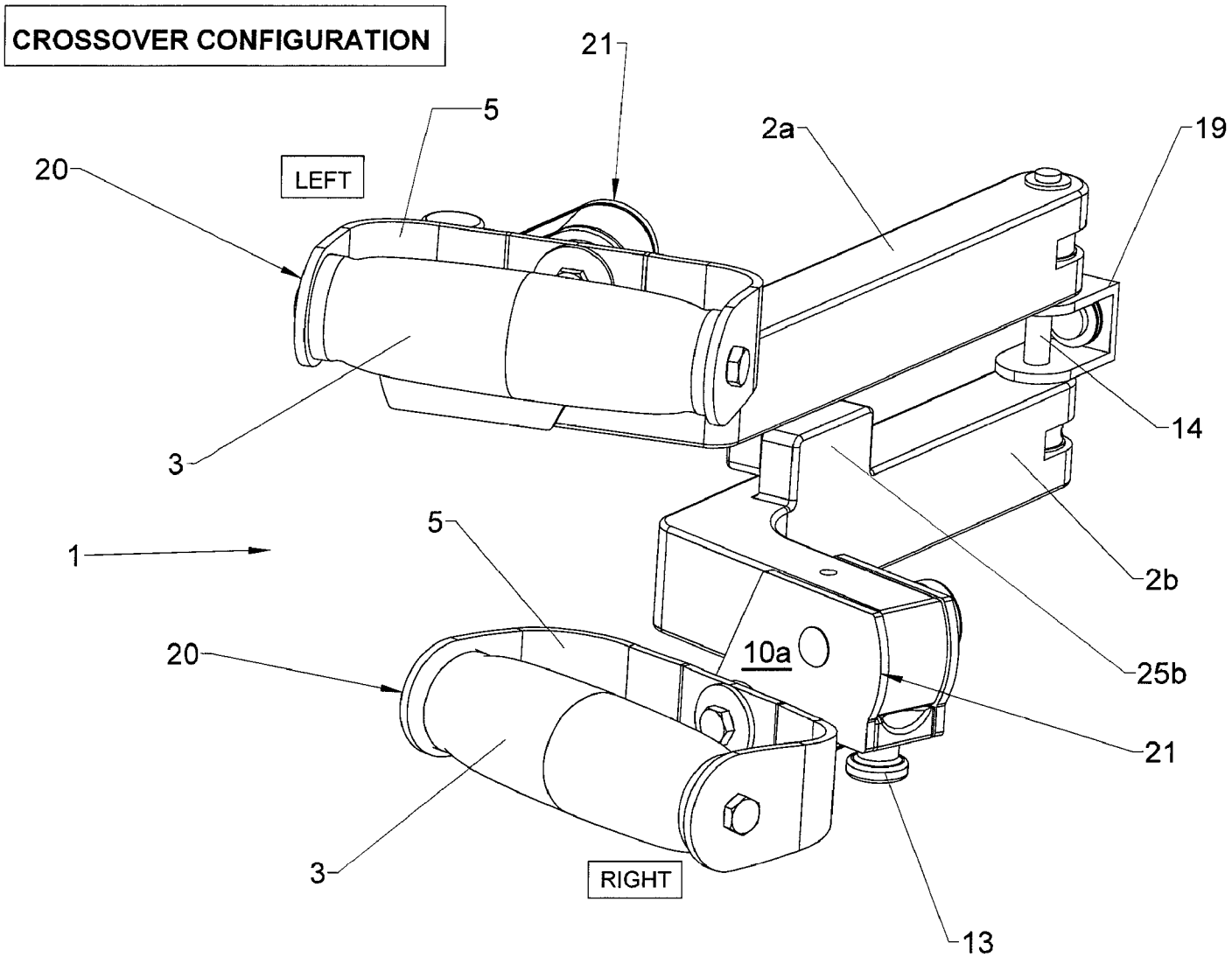
FIG. 3*a* is an isometric view of the rowing handle of FIG. 2*a* in the crossover configuration.
Figure 3C:
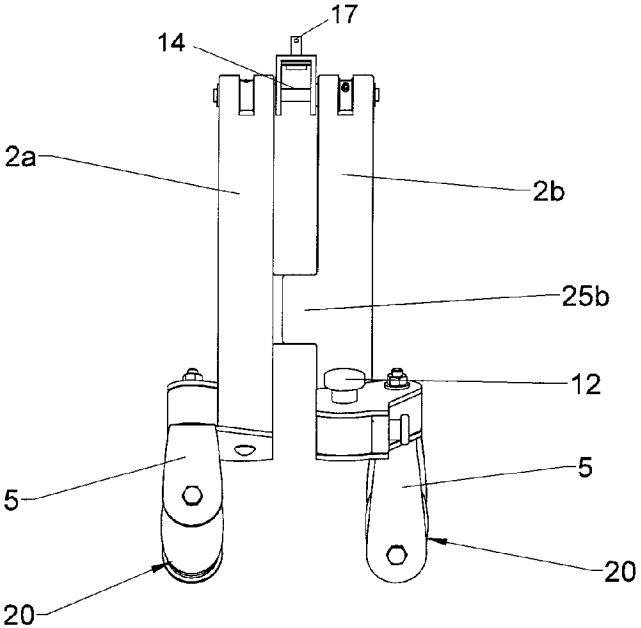
FIG. 3*c* is a side view of the rowing handle device of FIG. 3*a*
Figure 3B:
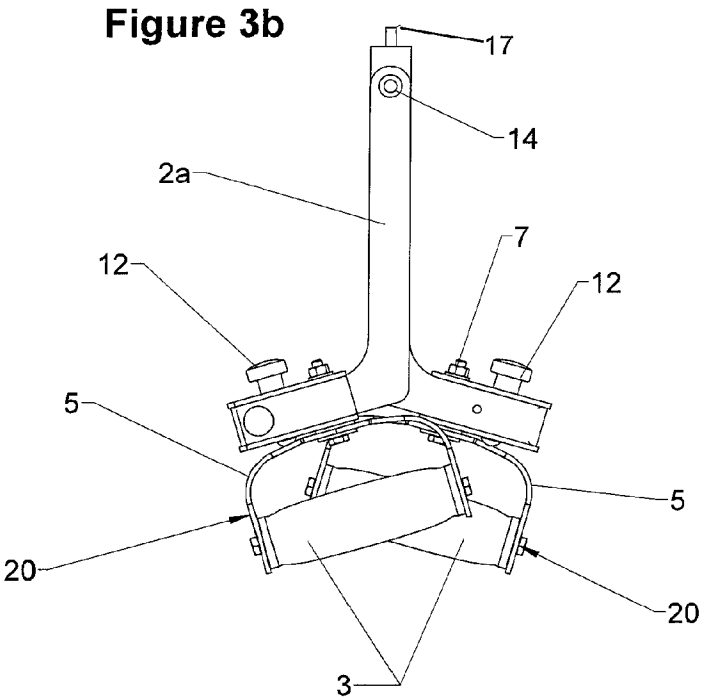
FIG. 3*b* is a top view of the rowing handle device of FIG. 3*a;*
Figure 3D:
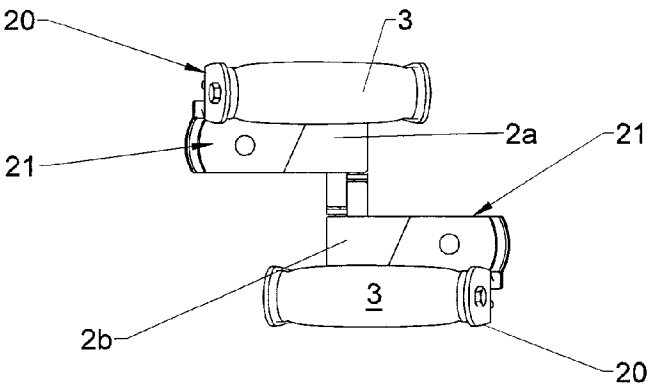
FIG. 3*d* is a front view of the rowing handle device of FIG. 3*a;*

With reference to FIGS. 2*a* to 4, an adjustable rowing machine handle 1 of the present invention can be switched between a standard configuration (FIGS. 2*a* to 2*d*) and a crossover configuration (FIGS. 3*a* to 3*d*). The standard configuration enables the user to replicate the rowing style normally used in a small open boat and familiar to most people, i.e. an oar grasped in each hand, with the hands starting beside each other in the same horizontal plane, and the oar handles moving through an arc, both hands moving in the same plane throughout the stroke.

The crossover configuration enables the user to replicate the rowing style familiar to competitive rowers, usually referred to as sculling, in which, an oar grasped in each hand, with the hands starting superposed with each other, e.g. 4 to 6 inches vertically apart, and the hands cross over each other during the stroke.

The handle 1 of the present invention includes a first L-shaped arm 2*a* pivotally mounted at one end to one end of a second L-shaped arm 2*b*, with the outer free ends of the arms 2*a* and 2*b* extending away from each other, in generally opposite directions. Each of the arms 2*a* and 2*b* includes a long section and a short section, which define a right or an obtuse angle. The long section extends from the chain or other form of connector, e.g. cord or strap, of the rowing machine in the direction of travel and along the axis, which the rower and the resistance device of the rowing machine apply their forces. The short section of each arm 2*a* and 2*b* are angled slightly towards the user, thereby simulating the starting position of the ends of the oars in the standard configuration with the hand grips at an obtuse angle to each other pointing along converging paths.

First and second (left and right) handgrips 20, each comprised of a roller handgrip 3 surrounding a handgrip core 4, are mounted on respective handgrip brackets 5 via threaded fasteners extending through the handgrip brackets 5 and axially into the handgrip core 4. One of the handgrip brackets 5 is rotatably mounted to the outer free end of each of the first and second arms 2*a* and 2*b* via bracket connecting bolt 6, friction nut 7, and low friction washer 8, so that the handgrip bracket 5 can rotate about and axis perpendicular to the handgrip 3 enabling the users wrists to rotate during the pushing and pulling of the rowing motion.

Further, since each handgrip bracket 5 can rotate freely about the handgrip-bracket connecting bolt 6, the user can vary both the magnitude and direction of rotation of the hands in both the power and return portion of the rowing stroke. Thus, the user is not physically restricted to the replication of any rowing style. In either configuration the user could hold both hands in a horizontal position throughout the rowing stroke, thereby matching the physical movement that would result when using a rigid single piece handle. Alternatively, the user could hold both hands in a vertical position throughout the stroke. The user could, in fact, start the stroke with both hands held in any position, vertical or horizontal, and rotate them to any other position (or not) as the stroke progresses. Although many of these variations do not match any rowing style, they are nevertheless completely viable and useful exercises, which would significantly broaden the scope of any rowing exercise device equipped with these articulated handles.

To enable one or both of the handgrips 20 to be pivoted from the standard configuration (FIG. 2*a*) to the crossover configuration (FIG. 3*a*) a handgrip pivoting bracket 21 is provided for one or both of the handgrip brackets 5. Ideally, both the first and second arms 2*a* and 2*b* are provided with a handgrip pivoting bracket 21 to provide the maximum separation between the handgrips 20 in the crossover configuration, but a single handgrip pivoting bracket 21 can be provided if a smaller separation is sufficient or if the single handgrip pivoting bracket 21 is provided with a sufficiently large radial arm providing the required separation between handgrips 20.

In the illustrated embodiment (see FIG. 4), the handgrip pivoting bracket 21 includes front and rear keeper plates 10*a* and 10*b*, respectively, pivotally connected to a respective one of the first and second arms 2*a* and 2*b* via a carriage bolt 11, defining the axis of rotation of the keeper plates 10*a* and 10*b* and the handgrip pivoting bracket 21. A clamping knob 12 is mounted on the end of the carriage bolt 11 for locking and releasing the keeper plates 10*a* and 10*b* in position. A keeper block 9 is pivotally connected to the keeper plates 10*a* and 10*b* via the handgrip-bracket connecting bolt 6, which extends through the handgrip bracket 5, through low friction washer 8, through the front keeper plate 10*a*, through the keeper block 9, through the rear keeper plate 10*b* to the friction nut 7. The keeper block 9 is secured or locked to the respective right or left arm 2*a* or 2*b* with a retaining knob 13, which is removable for securing into a lower retaining hole 31 in the lower surface of the right or left arm 2*a* or 2*b*, when in a first of the configurations, and into an upper retaining hole 32 in the upper surface of the right or left arm 2*a* or 2*b*, when in the other configuration.

Accordingly, the handgrip pivoting bracket 21 is pivotally mounted on the end of the first and/or second arms 2*a* and 2*b* along a first generally horizontal axis defined by the carriage bolt 11, and the handgrip brackets 5 are pivotally mounted to the handgrip pivoting bracket 21 along a second generally horizontal axis (generally parallel to the first axis) defined by the handgrip bracket connecting bolt 6. The distance between the first and second axis is a radial arm distance defining the arc that the handgrip 20 travels from the standard configuration to the crossover configuration.

First and second tabs 25*a* and 25*b* are provided on the first and second arms 2*a* and 2*b*, respectively, extending into each others path for abutting one another when the arms 2*a* and 2*b* are directly superposed, to prevent the arms 2*a* and 2*b* from crossing over, i.e. to prevent the left and right handgrips 20 from hitting each other.

The procedure of changing from one configuration to the other is illustrated in FIGS. 5*a* to 5*e*. First (FIGS. 4 & 5*a*) clamping knob 12 is loosened to enable the handgrip pivoting bracket 21 to rotate about the carriage bolt 11. Then, the retaining knob 13 is loosened and removed from the lower retaining hole 31 (FIG. 5*b*) to release the handgrip pivoting bracket 21 from the first arm 2*a*. The keeper block 9 is then rotated about handgrip bracket connecting bolt 6 (FIG. 5*c*), enabling the handgrip 3, the handgrip bracket 5, the keeper block 9, and keeper plates 10*a* and 10*b* to be rotated as a unit (FIG. 5*d*) about the carriage bolt 11 until the keeper block 9 is in its alternate position (FIG. 5*e*) on the opposite side of the first arm 2*a*. The retaining knob 13 is inserted through the keeper block again, and tightened into the matching threaded upper retaining hole 32 on the upper side of the first arm 2*a*. Lastly, the clamping knob 12 is retightened on the carriage bolt 11. This procedure is repeated for the other handgrip 20, if required, to complete the transition from one configuration (standard) to the other (crossover).

Figure 4:
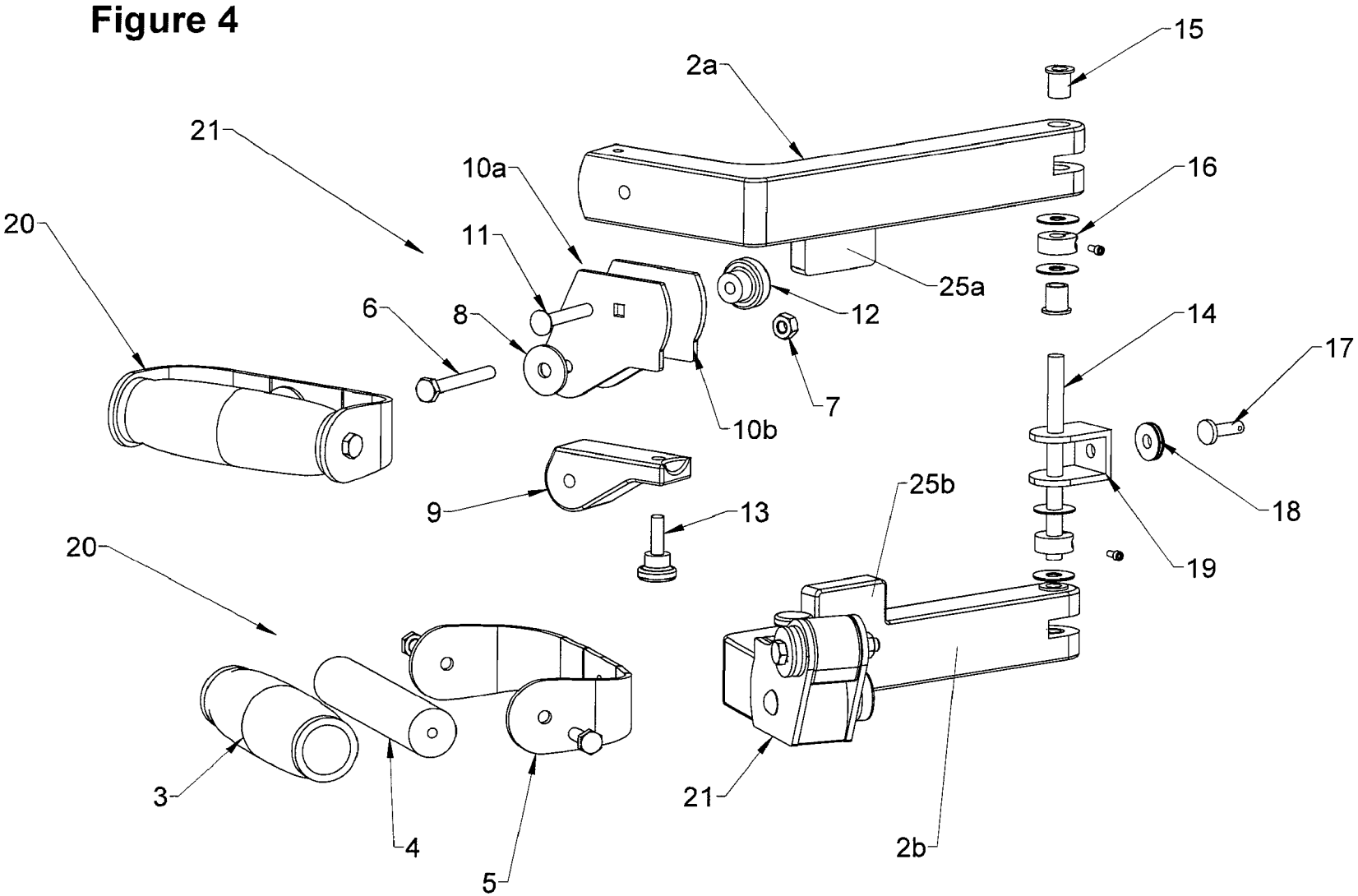
FIG. 4 is an exploded view of the rowing handle device of FIG. 2*a;*
Figures 5A, 5B, 5C, 5D, 5E:
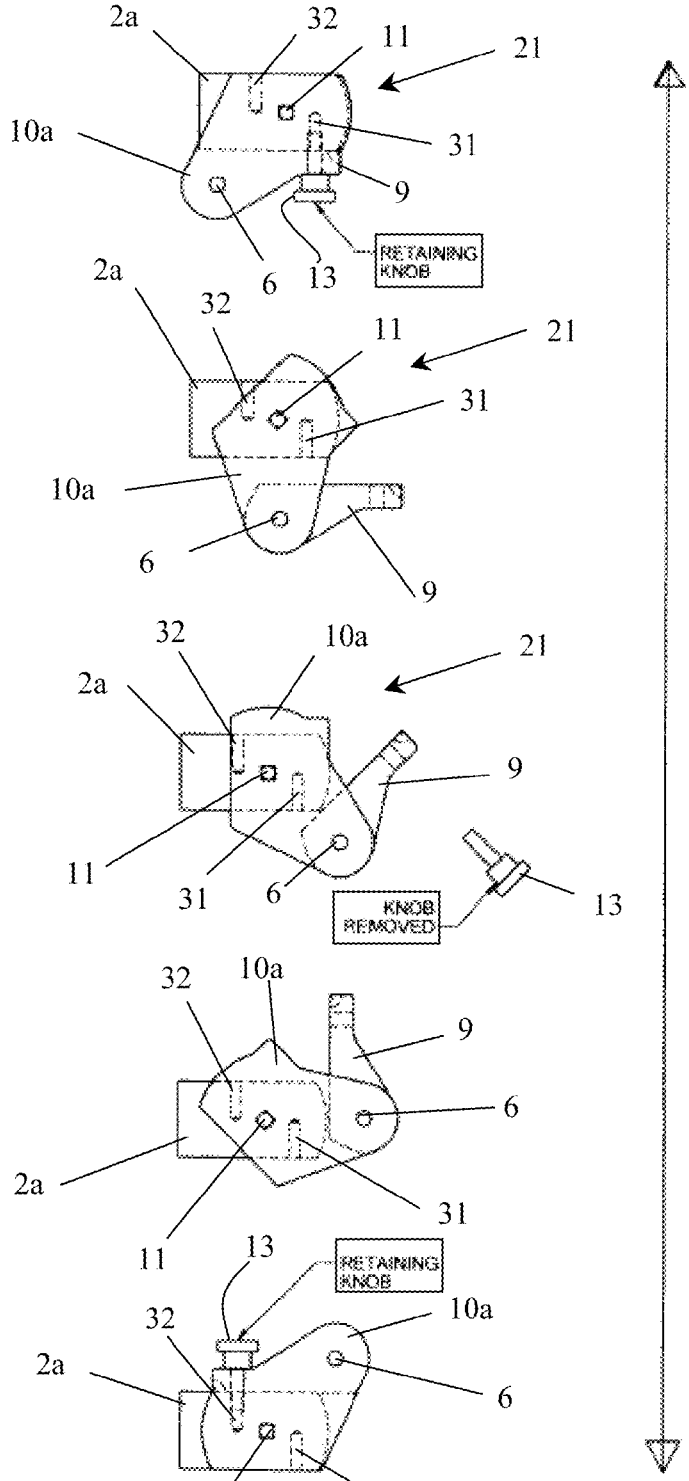
FIGS. 5*a* to 5*e* illustrate the various positions of the handgrip pivoting bracket of FIGS. 2 to 4.

With reference to FIG. 4, the ends of the first and second arms 2*a* and 2*b* are pivotally mounted on a pivot pin 14 defining an axis of rotation thereof. The pivot pin 14 extends through the ends of the first and second arms 2*a* and 2*b*, which are provided with suitable bearing and connecting elements, such as bearings 15, lock collar 16 and washers (two of which are shown). The pivot pin 14 also extends through a pin bracket 19 for connecting the pivot pin 14 to an end of the connector, e.g. chain, which extends to the resistance element, e.g. the rotational inertia device. The pin bracket 19 is pivotally mounted to the chain via a chain-connecting pin 17, defining a generally horizontal axis about which the pivot pin 14 can rotate.

In the illustrated embodiment of FIGS. 2*a* to 4, the first and second arms 2*a* and 2*b* are superposed, whereby when the handgrip pivoting bracket 21 of the upper arm 2*a* is rotated downwardly beneath the arm 2*a* and the handgrip pivoting bracket 21 of the lower arm 2*b* is rotated upwardly above the lower arm 2*b* (standard configuration) the handgrips 20 are generally aligned and adjacent horizontally (FIG. 2*a* to 2*d*). When the handgrip-pivoting bracket 21 of the upper arm 2*a* is rotated upwardly above the arm 2*a* and the handgrip-pivoting bracket 21 of the lower arm 2*b* is rotated downwardly below the lower arm 2*b* the handgrips 20 are generally aligned vertically and superposed (FIG. 3*a* to 3*d*). However, alternate embodiments are within the scope of the invention, in which the arms 2*a* and 2*b* are in the same horizontal plane, and have a mating configuration, whereby the main sections of the arms 2*a* and 2*b* having mating cross-sections, e.g. one has a c-shaped cross-section, for receiving the other when the handgrips 20 are close together.

Figure 6A:
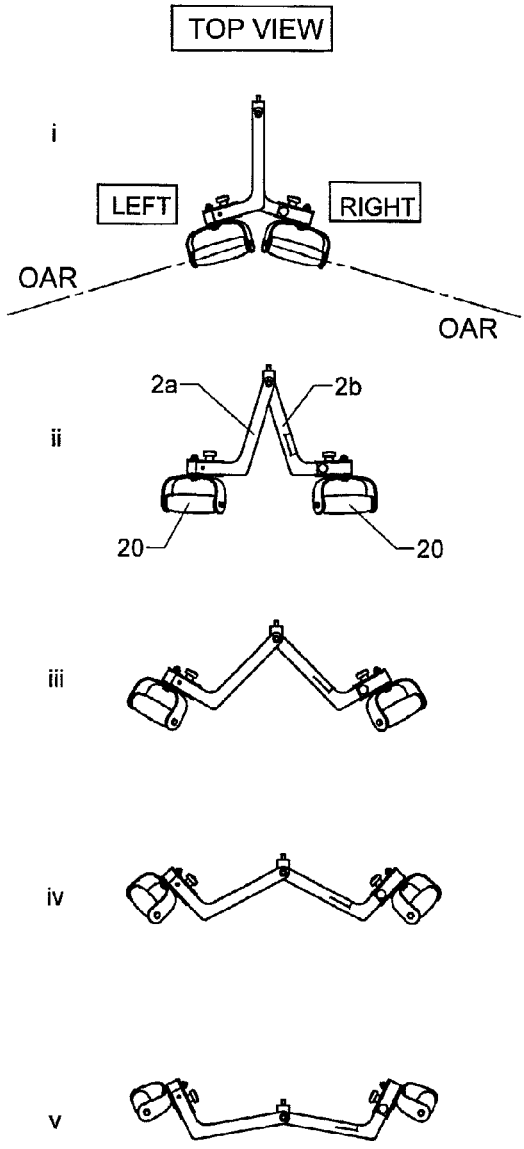
FIG. 6*a* is a top view of the rowing handle device of FIGS. 2*a* to 2*d* progressing through the rowing motion starting from the standard position.
Figure 6B:
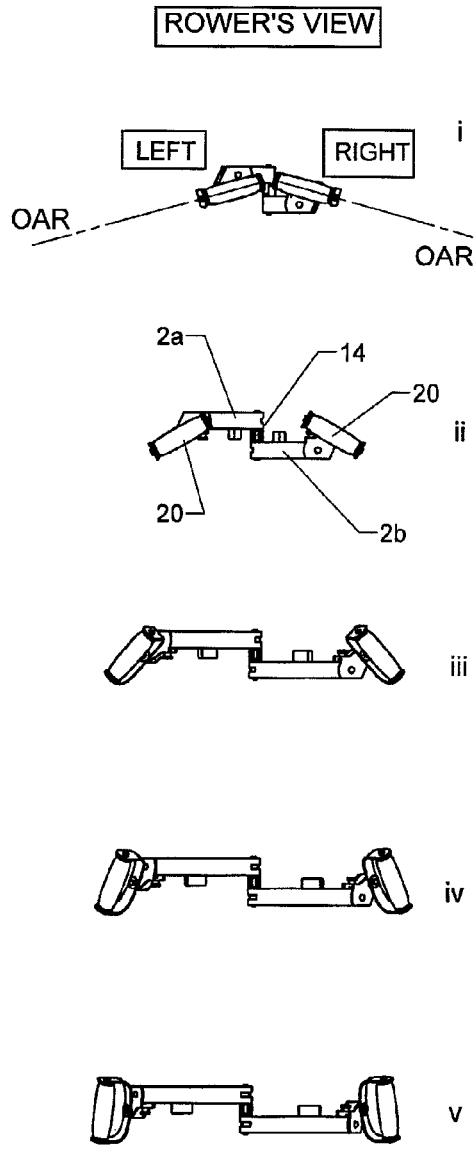
FIG. 6*b* is a front view of the rowing handle device of FIGS. 2*a* to 2*d* progressing through the rowing motion starting from the standard position.
Figure 7A:
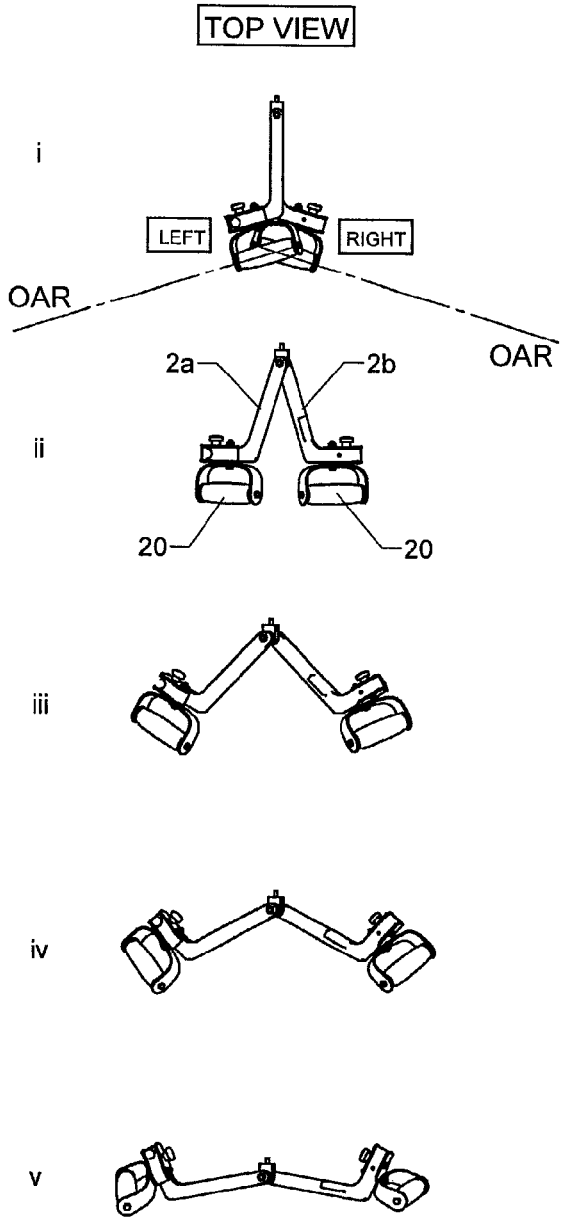
FIG. 7*a* is a top view of the rowing handle device of FIGS. 3*a* to 3*d* progressing through the rowing motion starting from the crossover position.
Figure 7B:
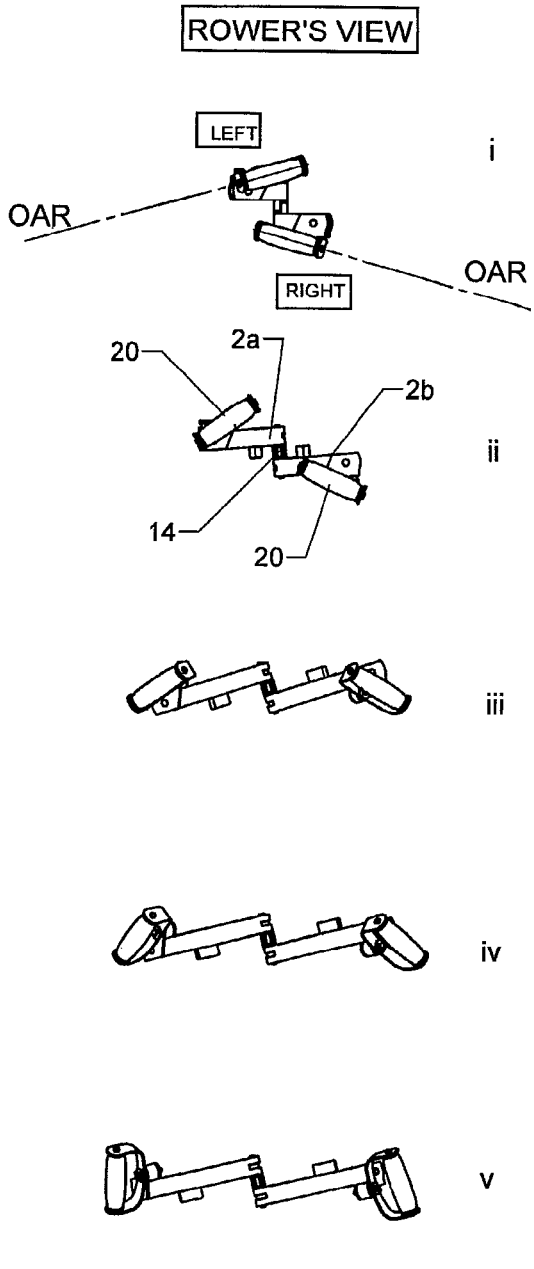
FIG. 7*b* is a front view of the rowing handle device of FIGS. 3*a* to 3*d* progressing through the rowing motion starting from the standard position.

FIGS. 6*a* and 6*b* illustrate typical handgrip 20 and arm 2*a* and 2*b* positions throughout the rowing stroke in the standard configuration, while FIGS. 7*a* and 7*b* illustrate typical handgrip 20 and arm 2*a* and 2*b* positions throughout the rowing stroke in the and crossover configuration. Note that at the beginning of the stroke, i.e. FIG. 6*b* (*i*) the user's hands, gripping the handgrips 20, are held at an acute angle to the horizontal that closely matches the angle of the hands gripping oars at the beginning of an actual rowing stroke, and also closely matching the natural angle of the human grip, i.e. the angle of a normal grip formed with the arm outstretched. The ergonomically correct relationship of grip to forearm position is maintained throughout the stroke. As the rowing stroke progresses, the pulling on the handles 1 by the user will cause each arm 2*a* and 2*b* to rotate about pivot pin 14, thereby causing the handgrip angle to change, i.e. FIG. 6*b* (*iii*), closely replicating the changing angle of the hands during actual rowing, and ensuring that the user's hands, wrists, and forearms remain comfortably aligned with the direction of the applied force. The alignment overcomes the primary deficiency and source of discomfort in using the rigid, single piece handle commonly utilized on rowing exercise devices in which the angle between the handgrip and the user's wrists and forearms changes dramatically throughout the stroke, stressing these joints.

Note that in the crossover configuration (FIG. 7*b*), pivot pin 14 is angularly displaced from the vertical by an acute angle (ideally between 0° and 45°). Thrust bearing 18 (FIG. 4) enables device 1 to rotate about the chain connecting pin 17, thus ensuring that the flywheel connector chain, to which device 1 is fastened, will not become twisted.

The arms 2*a* and 2*b* are at their maximum angle and the handgrips 20 are at their maximum distance from each other at the end of the stroke, i.e. FIGS. 6*a*(*v*), 6*b*(*v*), 7*a*(*v*) and 7*b*(*v*). The angle between the arms 2*a* and 2*b*, and the distance between the handgrips 20 eliminates the cramped and physically awkward finish to the stroke experienced using a rigid, single piece handle, allowing an increased range of motion of the user's arms and permitting a natural follow through at the completion of the stroke.

Figure 8A:
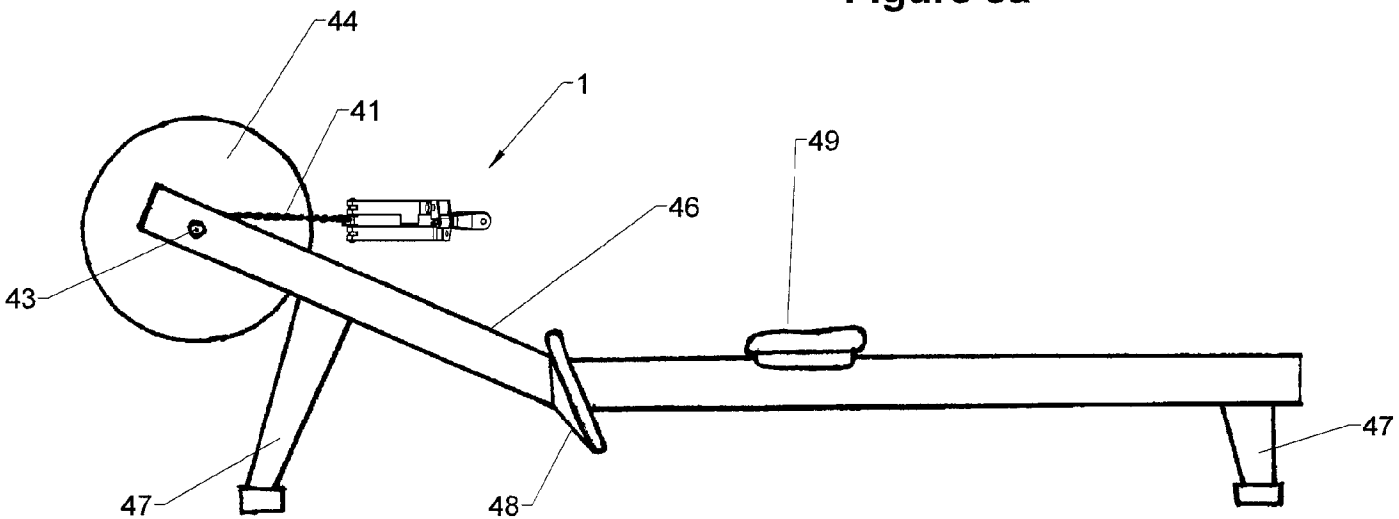
FIG. 8*a* is a side view of a rowing machine including the rowing handle device of FIGS. 2*a* to 2*d* in the standard position.
Figure 8B:
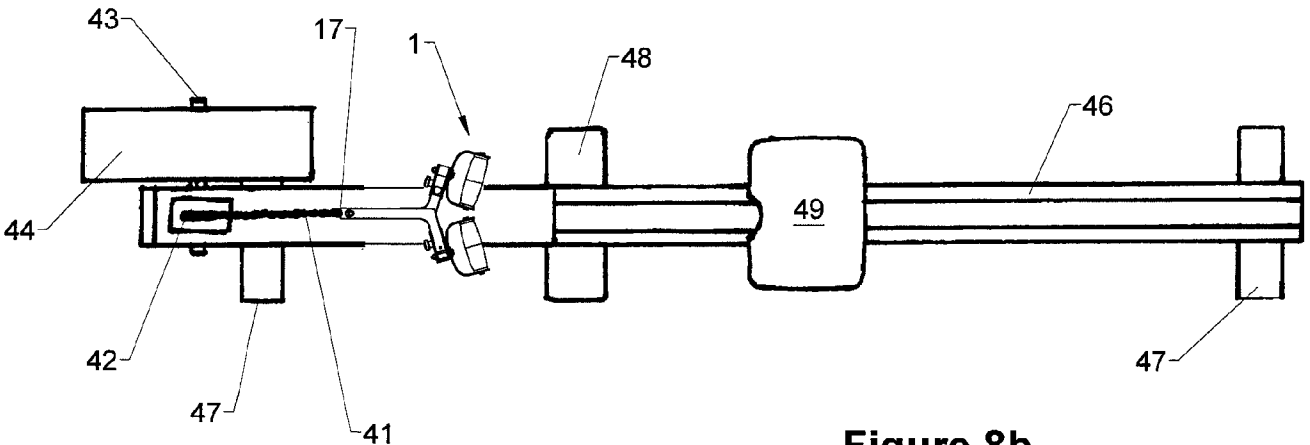
FIG. 8*b* is a top view of a rowing machine including the rowing handle device of FIGS. 2*a* to 2*d* in the standard position.
Figure 8C:
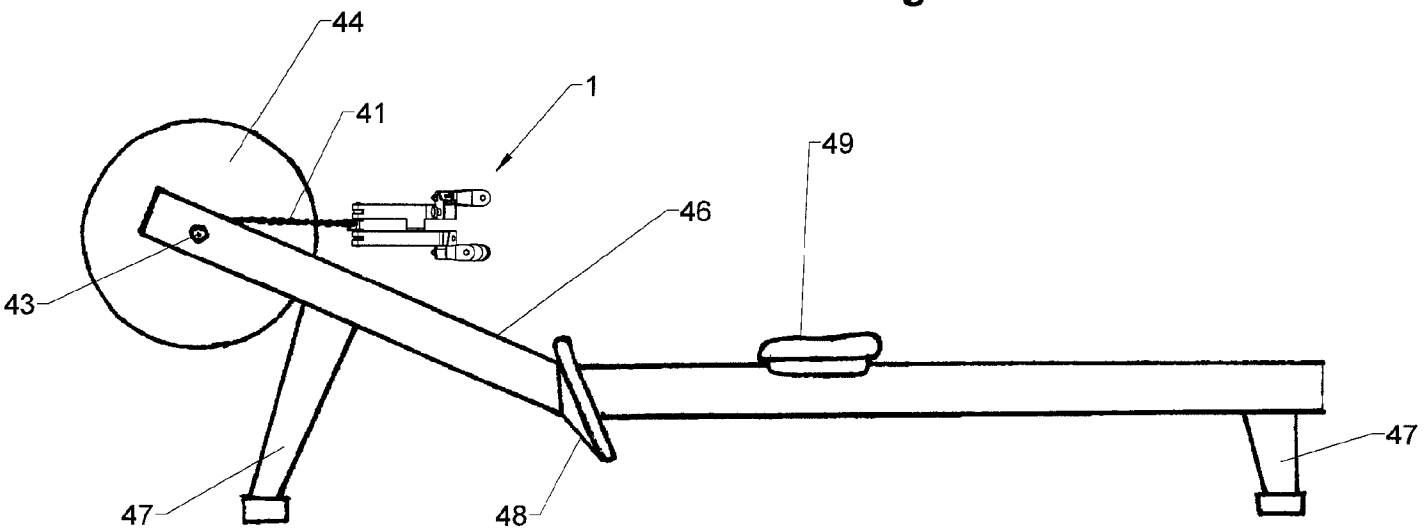
FIG. 8*c* is a side view of a rowing machine including the rowing handle device of FIGS. 3*a* to 3*d* in the crossover position.
Figure 8D:
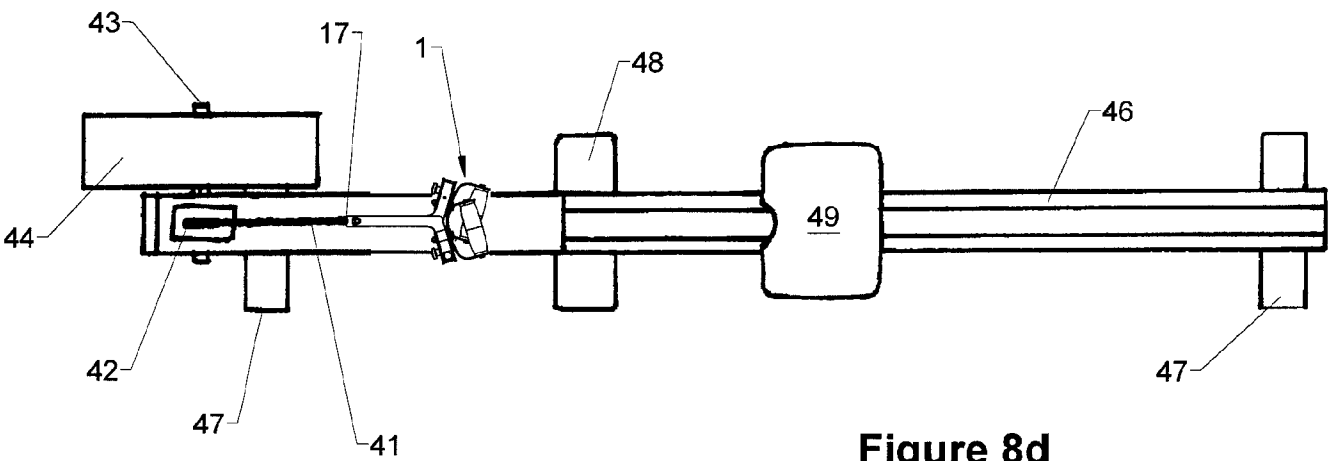
FIG. 8*d* is a top view of a rowing machine including the rowing handle device of FIGS. 3*a* to 3*d* in the crossover position.

With reference to FIGS. 8*a* to 8*d*, the connecting pin 17 of the handle 1 is connected to the end of a connector 41, e.g. linkage, chain, cord or strap, which engages a sprocket 42 mounted on a shaft 43 extending from a flywheel or other resistive device 44. The flywheel 44 is mounted on a frame 46, which includes ground engaging legs 47, foot rests 48, and sliding seat 49, whereby the user can reciprocate backward on the frame 46, while pulling on the connector 41 via the handle 1, and reciprocate forward on the frame 46, while the connector 41 is returned to the rest position by means of a suitable spring mechanism. FIGS. 8*a* and 8*b* illustrate the handle 1 in the standard configuration, while FIGS. 8*c* and 8*d* illustrate the handle 1 in the crossover configuration.

Figure 9:
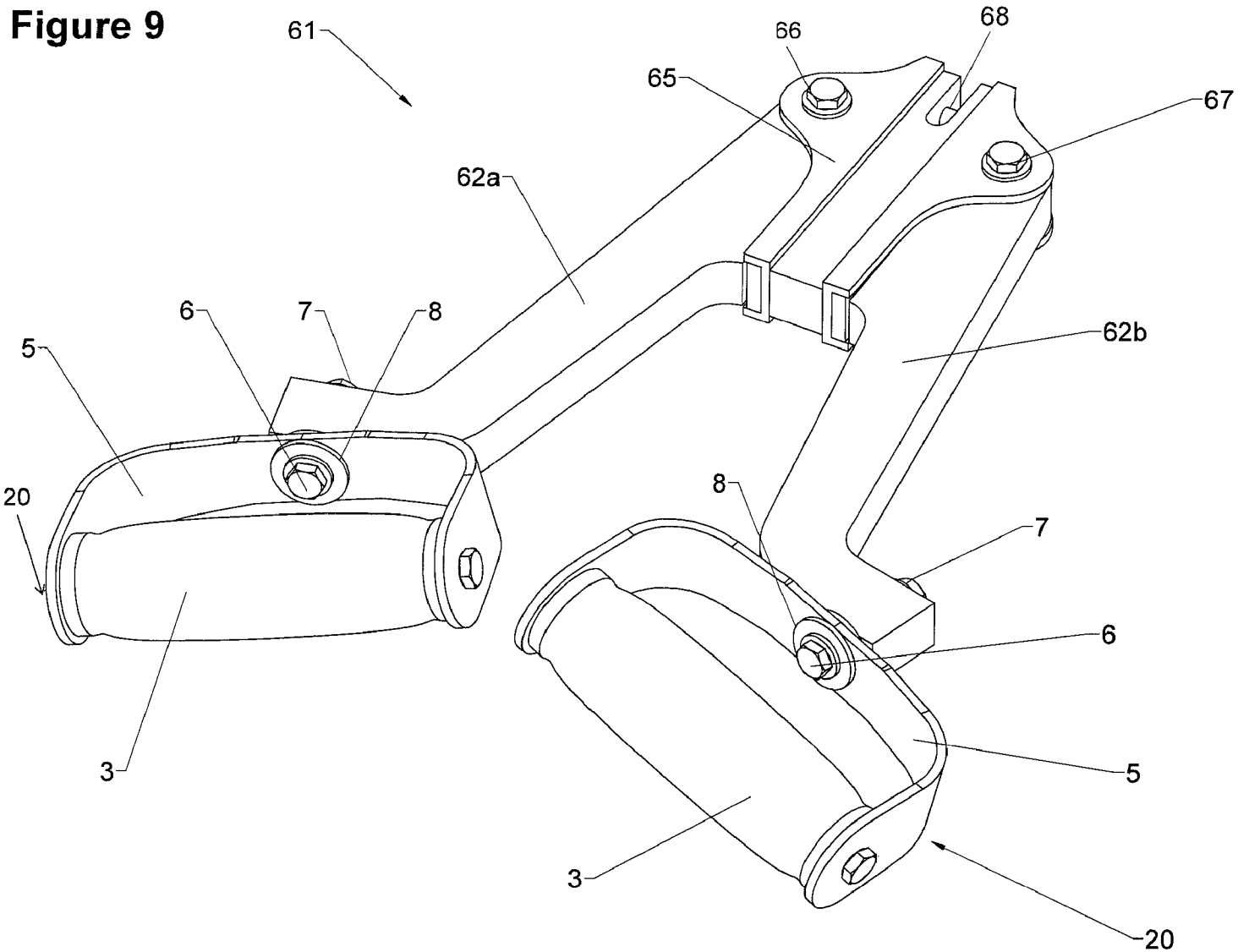
FIG. 9 illustrates an alternate embodiment of the rowing handle device of the present invention.

A handle 61, illustrated in FIG. 9, according to another embodiment of the present invention, enables the user to replicate the standard rowing style. The handle 61 of the present invention includes a first L-shaped arm 62*a* pivotally mounted at one end to one end of a second L-shaped arm 62*b*, with the outer free ends of the first and second arms 62*a* and 62*b* extending away from each other, in generally opposite directions. Each of the arms 62*a* and 62*b* includes a long section and a short section, which define an obtuse angle. The long section extends from the chain of the rowing machine in the direction of travel and along the axis, which the rower and the resistance device of the rowing machine apply their forces. The short section of each arm 62*a* and 62*b* are angled slightly towards the user, thereby simulating the start position of oars in the standard configuration with the handgrips at an obtuse angle to each other pointing along converging paths.

The first and second (left and right) handgrips 20, as above, each comprised of a roller handgrip 3 surrounding a handgrip core 4, are mounted on respective handgrip brackets 5 via threaded fasteners extending through the handgrip brackets 5 and axially into the handgrip core 4. One of the handgrip brackets 5 is rotatably mounted to the outer free end of each of the first and second arms 62*a* and 62*b* via bracket connecting bolt 6, friction nut 7, and low friction washer 8, so that the handgrip bracket 5 can rotate about and axis perpendicular to the handgrip 3 enabling the users wrists to rotate during the pushing and pulling of the rowing motion.

Figure 10A:
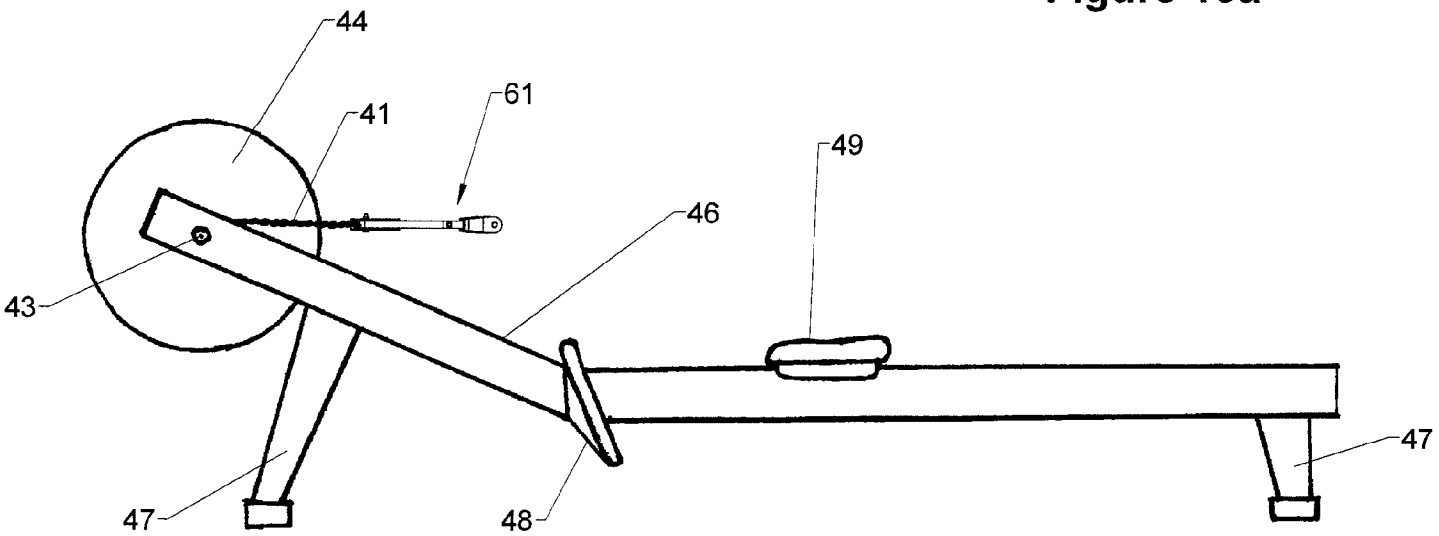
FIG. 10*a* is a side view of a rowing machine including the rowing handle device of FIG. 9 in the standard position.
Figure 10B:
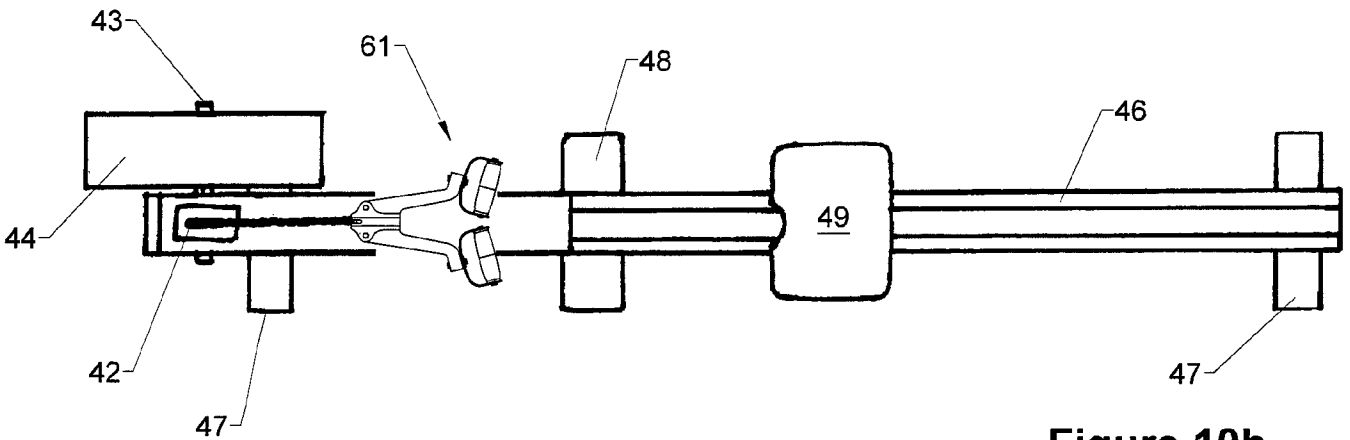
FIG. 10*b* is a top view of a rowing machine including the rowing handle device of FIG. 9 in the standard position.

The first arm 62*a* is pivotally mounted to a mounting bracket 65 via a first pivot pin 66, defining a first vertical axis of rotation. The second arm 62*b* is pivotally mounted to the mounting bracket 65 via a second pivot pin 67, defining a second vertical axis of rotation adjacent to and parallel to the first axis of rotation. A connecting pin or hook 68 is provided on the mounting bracket 65 for connecting the handle 61 to the connector 41. FIGS. 10*a* and 10*b*, similar to FIGS. 8*a* and 8*b*, illustrate the handle 61 on the rowing machine. As above, the handle 61 is connected to the end of the connector 41, which engages the sprocket 42 mounted on the shaft 43 extending from the flywheel or other resistive device 44. The flywheel 44 is mounted on the frame 46, which includes ground engaging legs 47, foot rests 48, and sliding seat 49, whereby the user can reciprocate backward on the frame 46, while pulling on the connector 41 via the handle 61, and reciprocate forward on the frame 46, while the connector 41 is returned to the rest position by means of a suitable spring mechanism.

Figure 11:
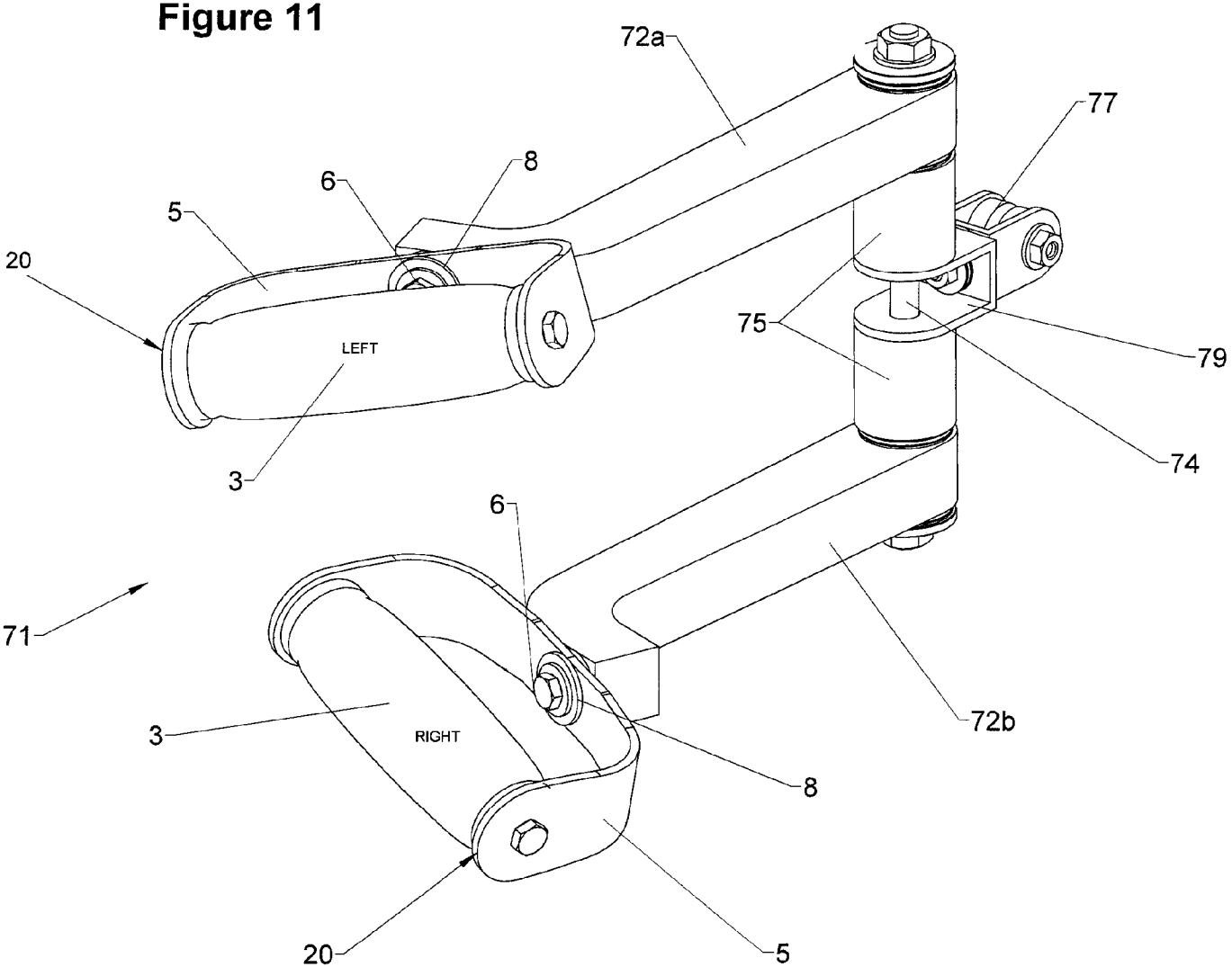
FIG. 11 illustrates an alternate embodiment of the rowing handle device of the present invention.

With reference to FIG. 11, a handle 71, according to another embodiment of the present invention, enables the user to replicate the cross-over rowing style. The handle 71 of the present invention includes a first L-shaped arm 72*a* superposed (4 to 6 inches apart, preferably 5 inches) and pivotally mounted at one end to one end of a second L-shaped arm 72*b*, with the outer free ends of first and second arms 72*a* and 72*b* extending away from each other, in generally opposite directions. Each of the arms 72*a* and 72*b* includes a long section and a short section, which define an obtuse angle. The long section extends from the chain of the rowing machine in the direction of travel and along the axis, which the rower and the resistance device of the rowing machine apply their forces. The short section of each arm 72*a* and 72*b* are angled slightly towards the user, thereby simulating the start position of oars in the cross-over configuration.

The first and second (left and right) handgrips 20, as above, each comprised of a roller handgrip 3 surrounding a handgrip core 4, are mounted on respective handgrip brackets 5 via threaded fasteners extending through the handgrip brackets 5 and axially into the handgrip core 4. One of the handgrip brackets 5 is rotatably mounted to the outer free end of each of the first and second arms 72*a* and 72*b* via bracket connecting bolt 6, friction nut 7, and low friction washer 8, so that the handgrip bracket 5 can rotate about and axis perpendicular to the handgrip 3 enabling the users wrists to rotate during the pushing and pulling of the rowing motion.

The ends of the first and second arms 72*a* and 72*b* are pivotally mounted on a pivot pin 74 defining a vertical axis of rotation thereof. The pivot pin 74 extends through the ends of the first and second arms 72*a* and 72*b*, which are provided with suitable bearing and connecting elements, such as bearings 75, lock collars and washers. The pivot pin 74 also extends through a pin bracket 79 for connecting the pivot pin 74 to an end of the connector 41, which extends to the resistance element, e.g. the rotational inertia device. The pin bracket 79 is pivotally mounted to the chain via a chain-connecting pin, hook or roller 77, defining a generally horizontal axis about which the pivot pin 74 can rotate.

Figure 12A:
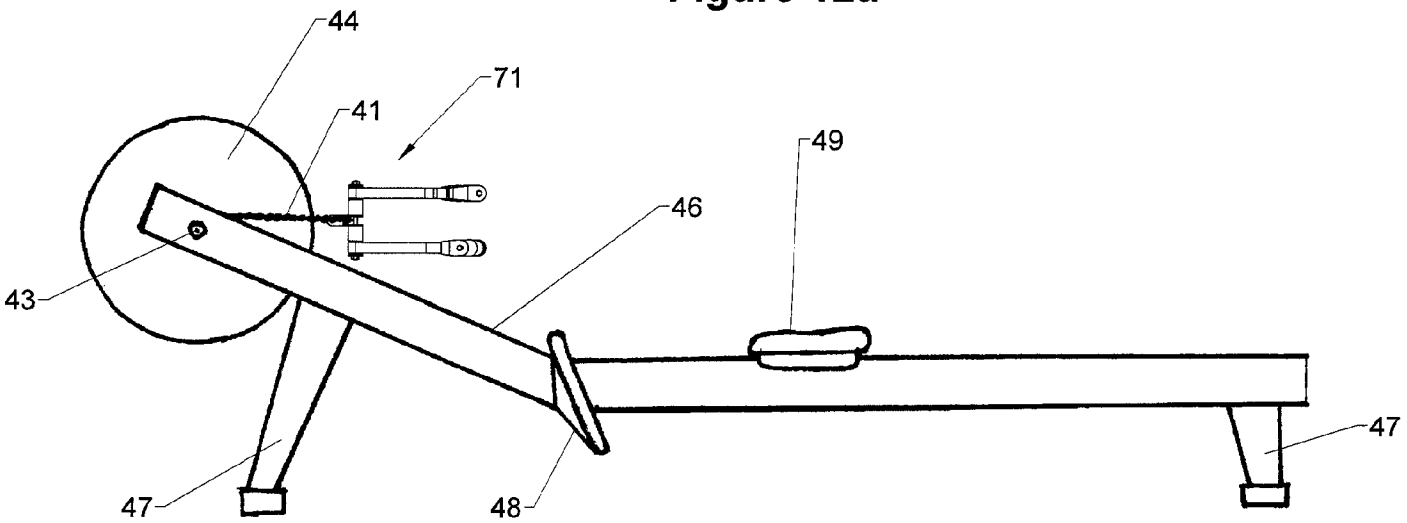
FIG. 12*a* is a side view of a rowing machine including the rowing handle device of FIG. 11 in the crossover position.
Figure 12B:
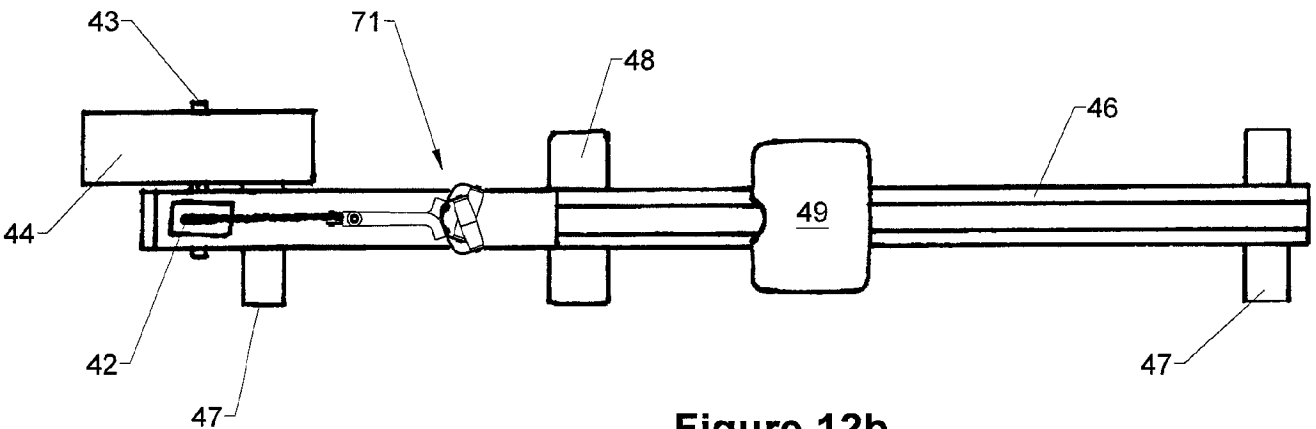
FIG. 12*b* is a top view of a rowing machine including the rowing handle device of FIG. 11 in the crossover position.

FIGS. 12*a* and 12*b*, similar to FIGS. 10*a* and 10*b*, illustrate the handle 71 on the rowing machine. As above, the handle 71 is connected to the end of the connector 41, which engages the sprocket 42 mounted on the shaft 43 extending from the flywheel or other resistive device 44. The flywheel 44 is mounted on the frame 46, which includes ground engaging legs 47, foot rests 48, and sliding seat 49, whereby the user can reciprocate backward on the frame 46, while pulling on the connector 41 via the handle 71, and reciprocate forward on the frame 46, while the connector 41 is returned to the rest position by means of a suitable spring mechanism.

Figure 13:
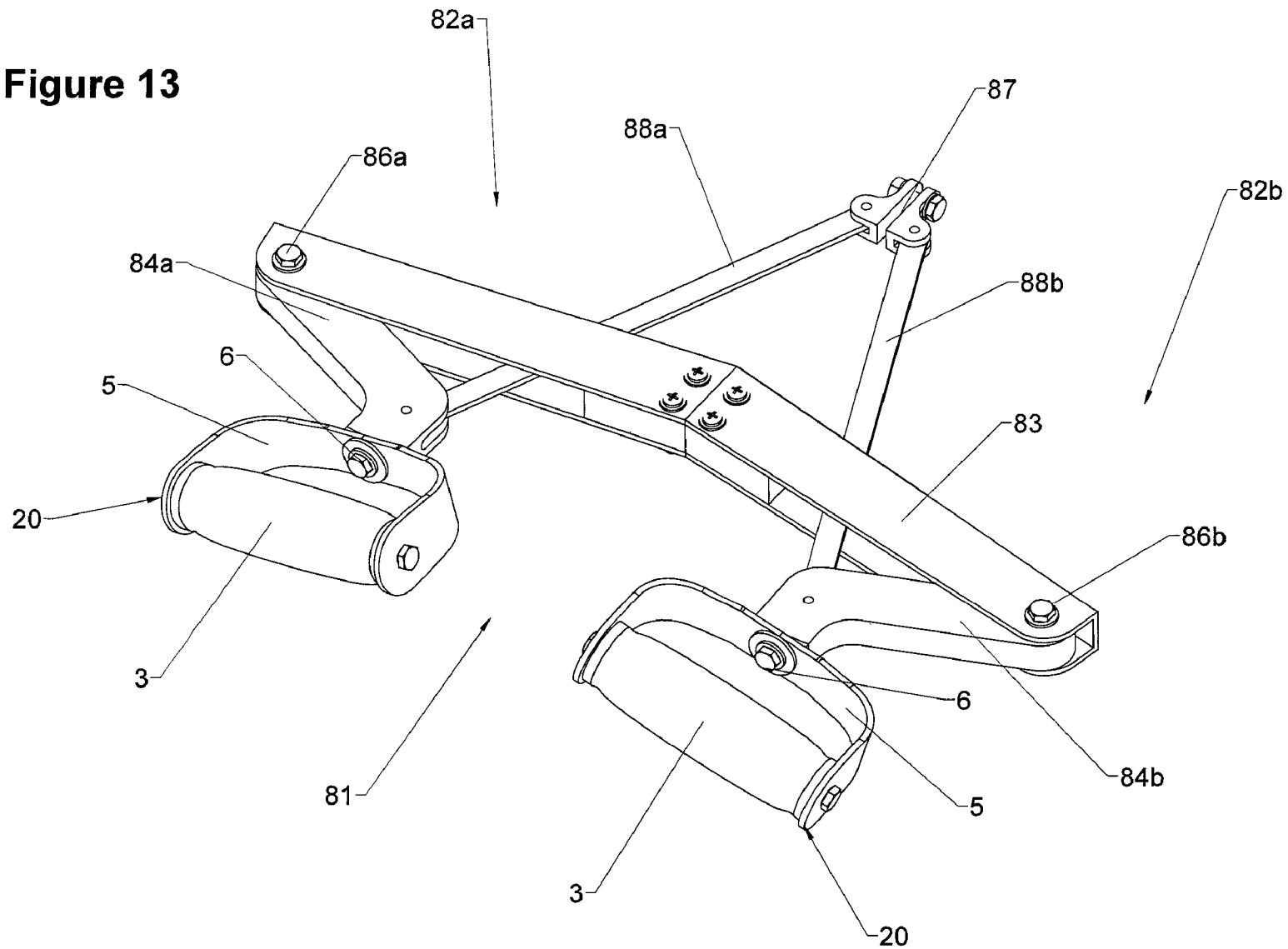
FIG. 13 illustrates an alternate embodiment of the rowing handle device of the present invention.

With reference to FIG. 13, a handle 81, according to another embodiment of the present invention, enables the user to replicate the standard rowing style. The handle 81 of the present invention includes a first arm structure 82*a* comprised of a first L-shaped arm 84*a* pivotally mounted at one end to one end of a elongated supporting bracket 83 via a first pin 86*a*, defining a first vertical axis of rotation, and a first linkage arm 88*a* pivotally connected to a chain bracket 87. A second arm structure 82*b* is comprised of a first L-shaped arm 84*b* pivotally connected to a second end of the supporting bracket 83 via a second pin 86*b*, defining a second vertical axis of rotation parallel to the first axis of rotation. The first and second (left and right) handgrips 20, as above, each comprised of a roller handgrip 3 surrounding a handgrip core 4, are mounted on respective handgrip brackets 5 via threaded fasteners extending through the handgrip brackets 5 and axially into the handgrip core 4. One of the handgrip brackets 5 is rotatably mounted to the outer free end of each of the first and second arms 84*a* and 84*b* via bracket connecting bolt 6, friction nut 7, and low friction washer 8, so that the handgrip bracket 5 can rotate about and axis perpendicular to the handgrip 3 enabling the users wrists to rotate during the pushing and pulling of the rowing motion. The first linkage arm 88*a* is pivotally mounted at one end to the first arm 84*a*, and extends to the chain bracket 87 at the other end. The second linkage arm 88*b* is pivotally mounted at one end to the second arm 84*b*, and extends to the chain bracket 87 at the other end. The other ends of the linkage arms 88*a* and 88*b* are pivotally mounted to the chain bracket 87.

Figure 14A:
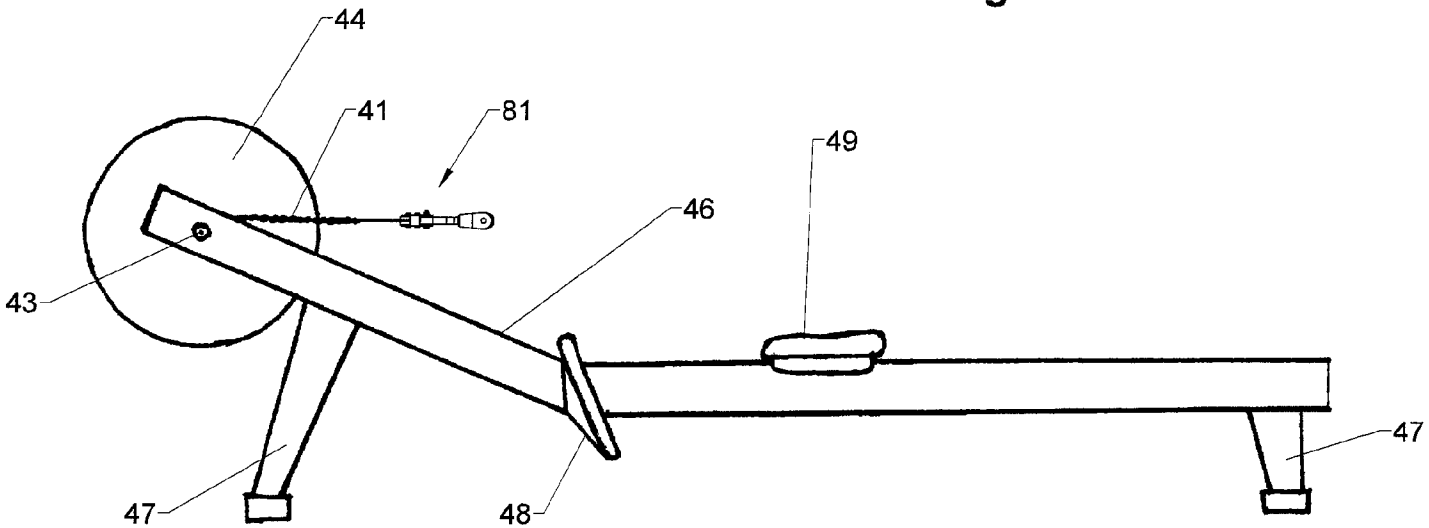
FIG. 14*a* is a side view of a rowing machine including the rowing handle device of FIG. 13 in the standard position.
Figure 14B:
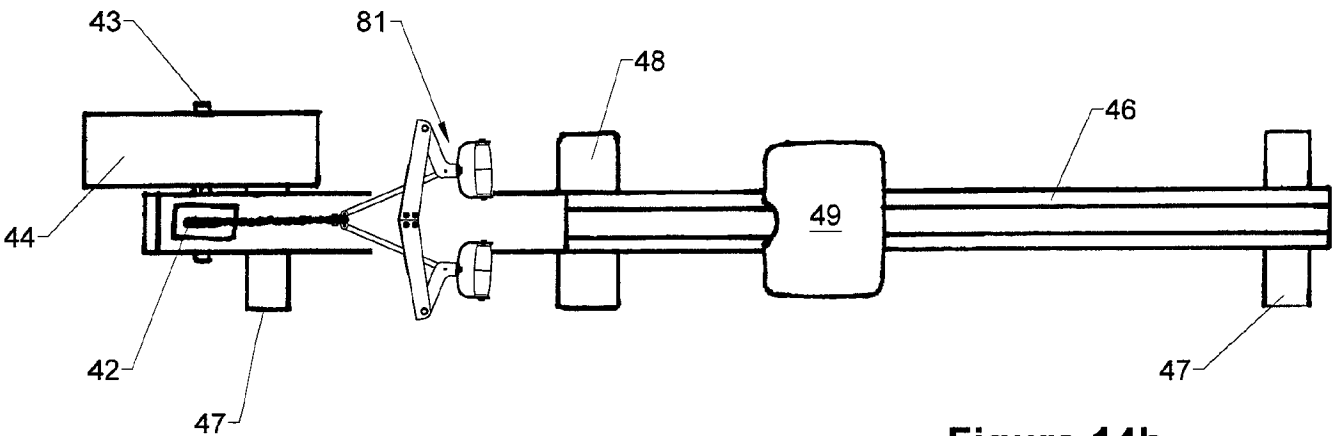
FIG. 14*b* is a top view of a rowing machine including the rowing handle device of FIG. 13 in the standard position.

FIGS. 14*a* and 14*b*, similar to FIGS. 8*a* and 8*b*, illustrate the handle 81 on the rowing machine. As above, the handle 81 is connected to the end of the connector 41, which engages the sprocket 42 mounted on the shaft 43 extending from the flywheel or other resistive device 44. The flywheel 44 is mounted on the frame 46, which includes ground engaging legs 47, foot rests 48, and sliding seat 49, whereby the user can reciprocate backward on the frame 46, while pulling on the connector 41 via the handle 81, and reciprocate forward on the frame 46, while the connector 41 is returned to the rest position by means of a suitable spring mechanism. Due to a changing mechanical advantage as the ends of the arms 82*a* and 82*b* spread apart, the resistance to that spread diminishes noticeably at the end of the rowing stroke, which replicates the resistance at the end of a rowing stroke, i.e. the resistance decreases as the oars come out of the water.

Figure 15B:
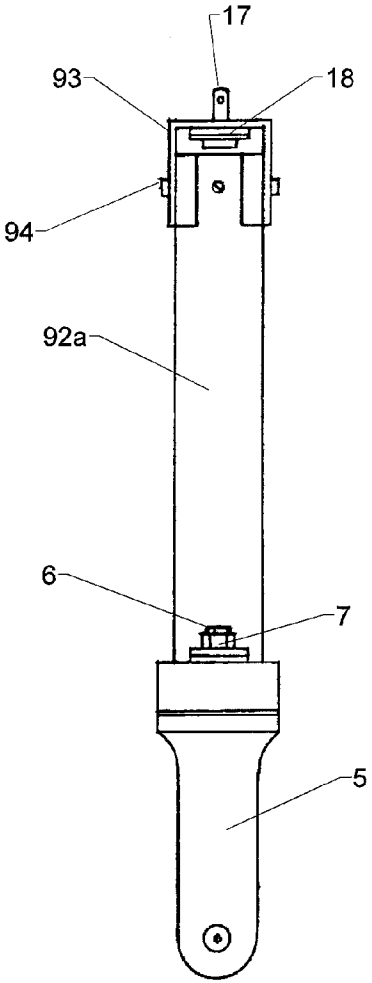
FIGS. 15*a* and 15*b* illustrate alternate embodiments of the rowing handle device of the present invention.
Figure 15A:
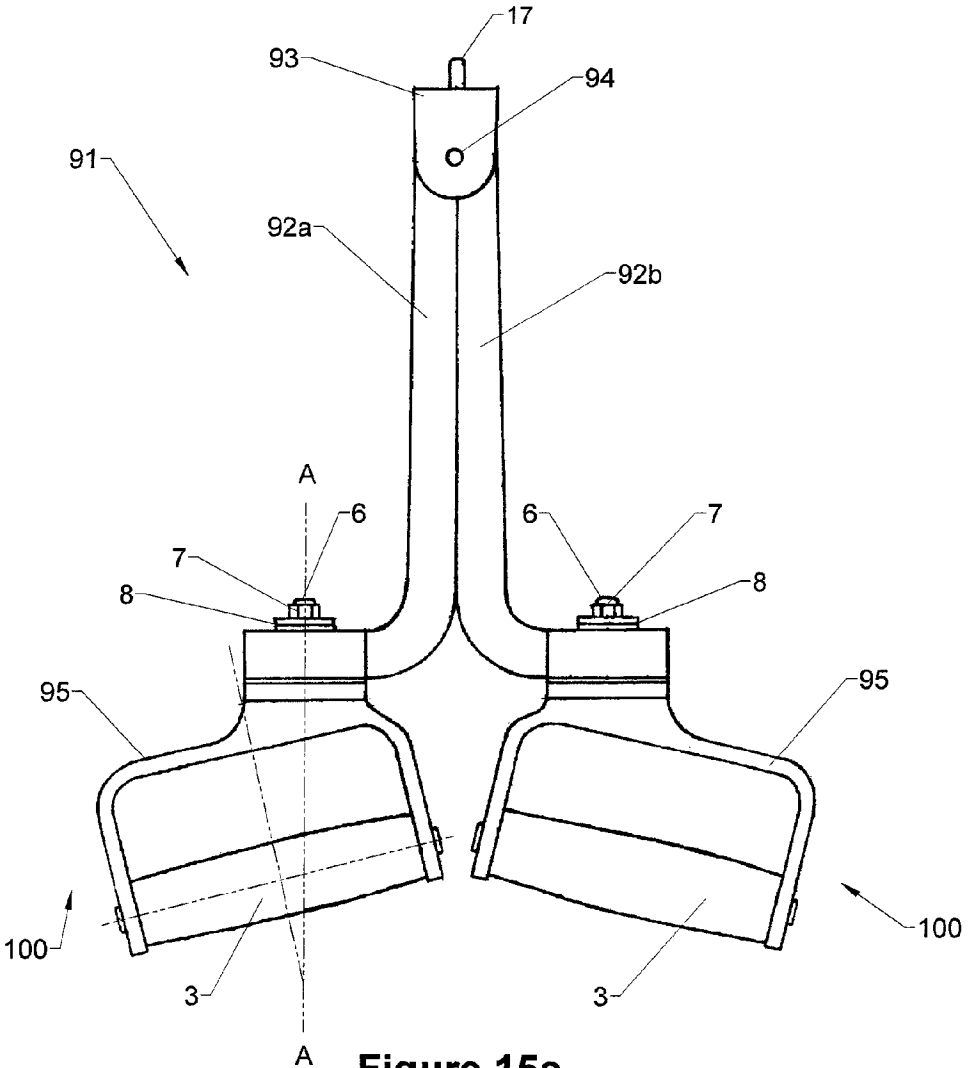
Figure 16A:
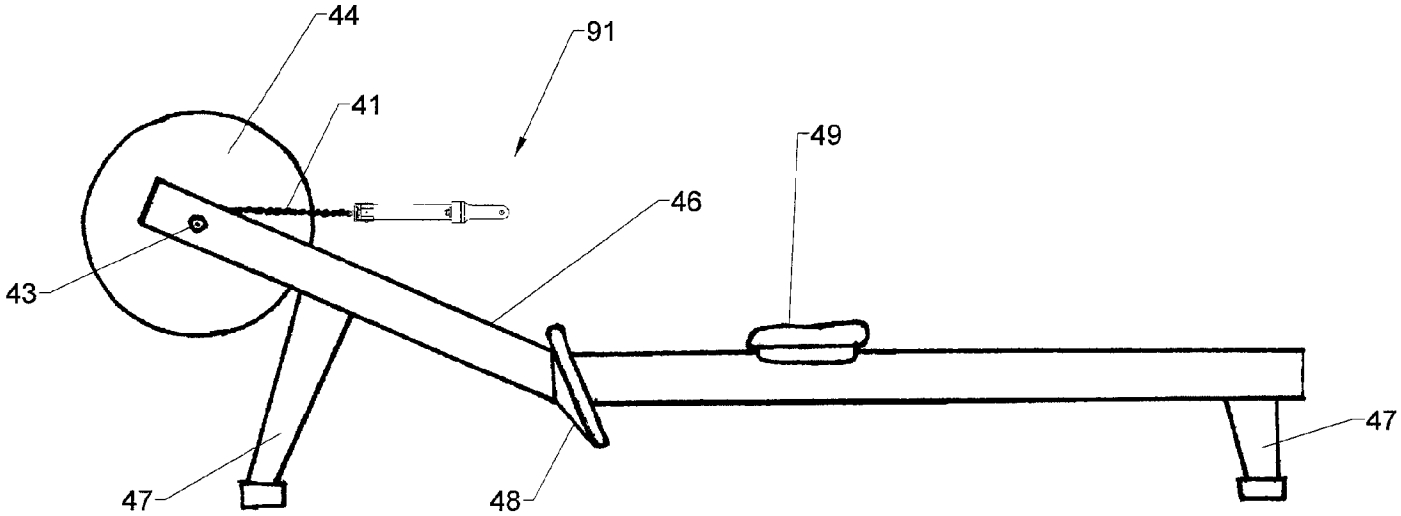
FIG. 16*a* is a side view of a rowing machine including the rowing handle device of FIG. 15 in the standard position.
Figure 16B:
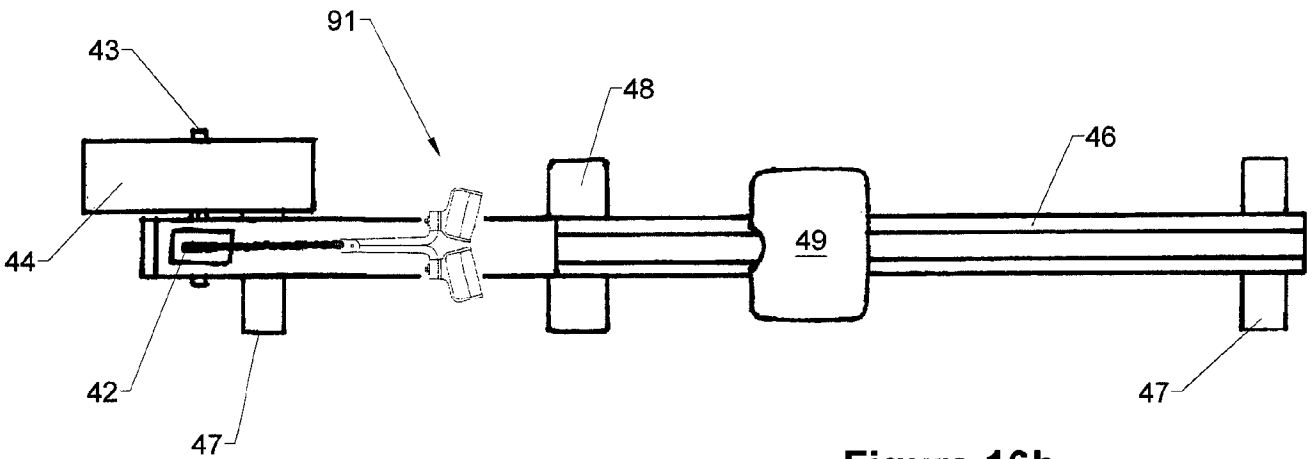
FIG. 16*b* is a top view of a rowing machine including the rowing handle device of FIG. 15 in the standard position.

A handle 91 of the present invention, illustrated in FIGS. 15*a* and 15*b*, includes a first L-shaped arm 92*a* pivotally mounted at one end to one end of a second L-shaped arm 92*b*, with the outer free ends of the arms 92*a* and 92*b* extending away from each other, in generally opposite directions. Each of the arms 92*a* and 92*b* includes a elongated section and a shorter section, which generally define a right angle; however, other angles are possible, e.g. acute angles of 85° or more, and obtuse angles of less than 95°. The elongated section extends from the connector 41 of the rowing machine in the direction of travel and along the axis, which the rower and the resistance device of the rowing machine apply their respective forces. A C-shaped mounting bracket 93 sandwiches the ends of the first and second arms 92*a* and 92*b* together, and retains the ends of a pivot pin 94, which extends through the ends of the first and second arms 92*a* and 92*b*, defining a vertical pivot axis, when the handle 91 is in the standard configuration, illustrated in FIG. 15*a*. Thrust bearing 18 and connecting pin 17 are also mounted on the mounting bracket 93 for connecting to the connector 41, as hereinbefore explained.

First and second (left and right) handgrips 100, each comprised of a roller handgrip 3 surrounding a handgrip core 4, are mounted on respective angled handgrip brackets 95 via threaded fasteners extending through the angled handgrip brackets 95 and axially into the handgrip core 4. One of the angled handgrip brackets 95 is rotatably mounted to the outer free end of each of the first and second arms 92*a* and 92*b* via bracket connecting bolt 6, friction nut 7, and low friction washer 8, so that the handgrip brackets 95 can rotate about an axis perpendicular to the shorter section of arms 92*a* and 92*b* enabling the users wrists to rotate during the pushing and pulling of the rowing motion.

Further, since each handgrip bracket 95 can rotate freely about the handgrip-bracket connecting bolt 6, the user can vary both the magnitude and direction of rotation of the wrists and hands in both the power and return portion of the rowing stroke. Thus, the user is not physically restricted to the replication of any rowing style. In either configuration the user could hold both hands in a horizontal position throughout the rowing stroke, thereby matching the physical movement that would result when using a rigid single piece handle. Alternatively, the user could hold both hands in a vertical position throughout the stroke. The user could, in fact, start the stroke with both hands held in any position, vertical or horizontal, and rotate them about force applying axis to any other position (or not) as the stroke progresses. Although many of these variations do not match any rowing style, they are nevertheless completely viable and useful exercises, which would significantly broaden the scope of any rowing exercise device equipped with these articulated handles.

Although in this embodiment the handgrip bracket 95 can still rotate freely about axis A defined by the handgrip bracket connecting bolt 6, the roller handgrip 3 is mounted at an acute angle to the axis A, i.e. at an acute angle to the shorter section of the arm 92*a*, rather than perpendicular to the axis of rotation as in the aforementioned embodiments. Moreover, the plane of rotation of the handgrip bracket 95 is approximately parallel to the user's chest, i.e. the axis of rotation defined by the handgrip bracket connecting bolt 6 is perpendicular to the user's chest, at the beginning of the rowing stroke, unlike the aforementioned embodiments in which the plane of rotation and the axis of rotation, is at an acute angle in relation to the user's chest at the beginning of the rowing stroke.

Since the aforementioned plane of rotation of the handgrip bracket 95 is approximately parallel to the user's chest at the beginning of the stroke, and since the roller handgrip 3 is mounted at an acute angle to that plane of rotation, the entire handle 91 can be rotated either clockwise or counterclockwise about chain connecting pin 17, and the angle of the handgrip 3 in relation to the user's chest will remain unchanged. Accordingly, regardless of whether the handgrips 3 are aligned horizontally or displaced vertically at the beginning of the rowing stroke, the handgrip angles will always approximate the angles of the handgrips of oars at the beginning of an actual rowing stroke. From either the horizontal or vertical displacement position at the beginning of the stroke, the handgrips 3 will follow a smooth, aberration free angular progression in both the power and recovery phases of the rowing stroke.

The handgrip bracket connecting bolt 6 is not centered on the handgrip bracket 95, but displaced to one side, i.e. towards the center line of the handle 91, which reduces the vertical separation of the handgrips 3 when the handle 91 is rotated during replication of the crossover style of rowing, so that the vertical displacement and separation of the roller handgrips 3 more closely approximates that which is experienced during actual rowing.

The previously disclosed handles 1, 71, and 91 (FIGS. 2*a*, 11 and 15*a*, respectively) enable the user to exercise using the sculling-style, i.e. one hand crossing over the other, of rowing stroke. The handles 1, 71 and 91 ensure a smooth and natural angular progression of the handgrips 20 or 100, which closely replicates the angular progression of oar handles during actual rowing when the sculling style of stroke is used. However, the rate of that angular progression of the handgrips 20 or 100 about the axis defined by the handgrip connecting bolt 6 is unregulated, and therefore, when exercising, the rate or angular progression is not necessarily in accord with the rate of angular progression experienced during actual rowing.

With handles 1, 71, and 91, as the stroke progresses and the user's hands move from a crossover position to a horizontally aligned position, the handle arms 2*a* and 2*b* (72*a* and 72*b* or 92*a* and 92*b*) rotate about the chain-connecting pin, e.g. pin 17 for handle 91. Since there is negligible resistance to this arm rotation, the user's hands tend to move from a crossover to an aligned position at a rate exceeding that experienced during actual rowing, unless the user tenses the arm and shoulder muscles to offset this tendency. This is experienced as a minor defect for short duration exercise sessions, but for longer workouts, the user is unable, through fatigue, to sustain the necessary tensioning of the arm and shoulder muscles and this results in the stroke progressing with unnatural rapidity from a crossover to an aligned position of the hands.

Figure 17:
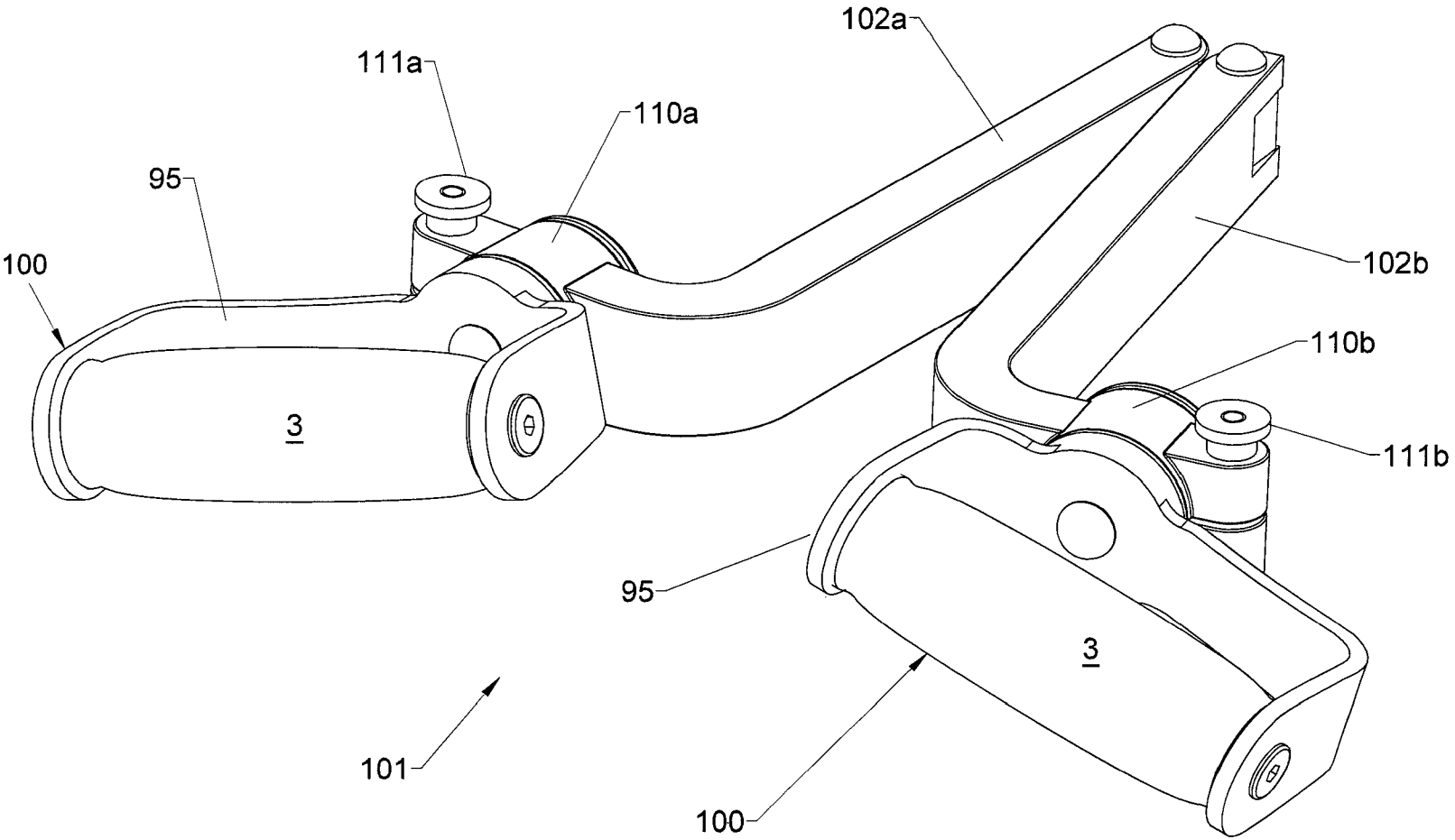
FIG. 17 is an isometric view of the device.
Figure 18B:
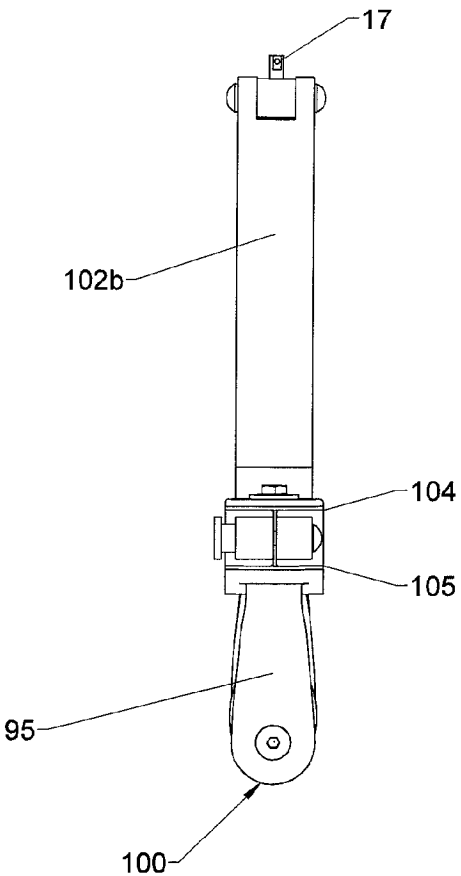
FIG. 18*b* is a side view of the device.
Figure 18A:
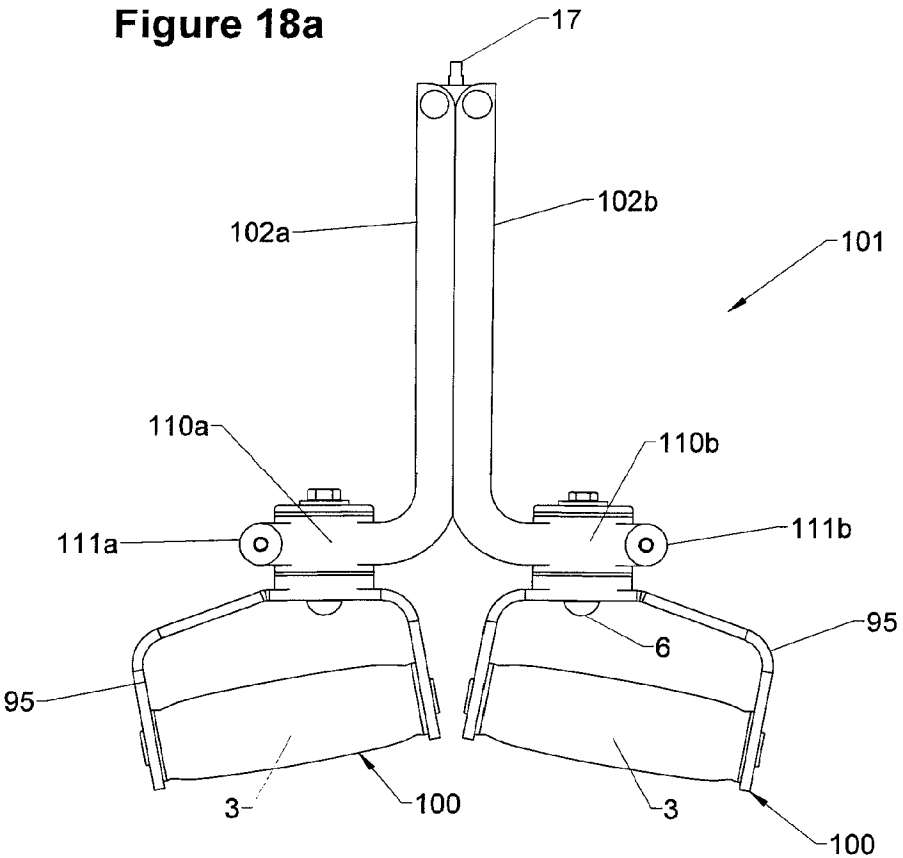
FIG. 18*a* is a top view of the device.
Figure 18C:
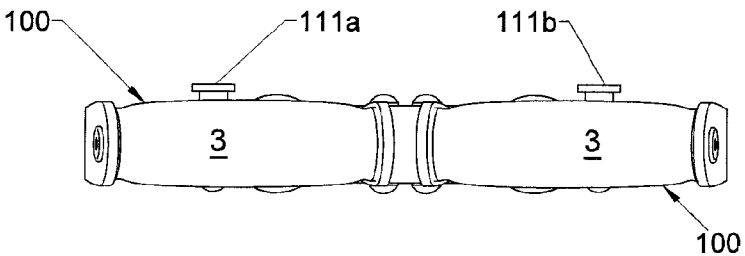
FIG. 18*c* is an end view of the device.

A handle 101, illustrated in FIG. 17, is substantially identical in dimension and geometry to handle 91; however, handle 101 incorporates an adjustable friction clutch mechanism 110*a* and 110*b* at the axis of rotation of each handgrip bracket 95 mounted on the ends of arms 102*a* and 102*b*, respectively. Typically, although not exclusively, each friction clutch 110*a* and 110*b* incorporates small roller bearings on internal ramps which "lock-up" and grip the shaft in one direction, but allow free rotation in the other direction. By means of an adjustment knob 111*a* and 111*b* adjacent to each handgrip 100, the user can regulate the rate of angular progression of the handgrips 100 when exercising using the sculling style of rowing stroke. Fidelity to the rate of angular progression of actual rowing can be set and maintained, or other rates of angular progression can be chosen at the user's preference.

Incorporating adjustable friction clutch mechanisms 110*a* and 110*b* into the design of handles 102*a* and 102*b* eliminates the necessity of arm and shoulder muscle tensioning to regulate the rate of angular progression of the handgrips 100 when exercising using the sculling style of rowing stroke. The uni-directional friction clutches 110*a* and 110*b* provide a user adjustable resistance to the clockwise rotation of the handgrip assembly 100 in relation to handle arms 102*a* and 102*b*, respectively, which corrects the tendency of the user's hands to move too quickly from a crossover to a horizontally displaced position. During the recovery (return) portion of the rowing stroke, the uni-directional friction clutches 110*a* and 110*b* offer negligible resistance to the counterclockwise rotation of the handle assembly 100 in relation to the handle arms 102*a* and 102*b*, respectively, faithfully replicating the lack of resistance in actual rowing as the user's hands return to the starting crossover position.

During the power portion of the rowing stroke, as the left and right handgrips 100 move from a left hand over right hand position to a horizontally displaced position, the left and right handgrips 100 rotate clockwise in relation to handle arms 102*a* and 102*b*. See FIG. 22*b*

Figure 19:
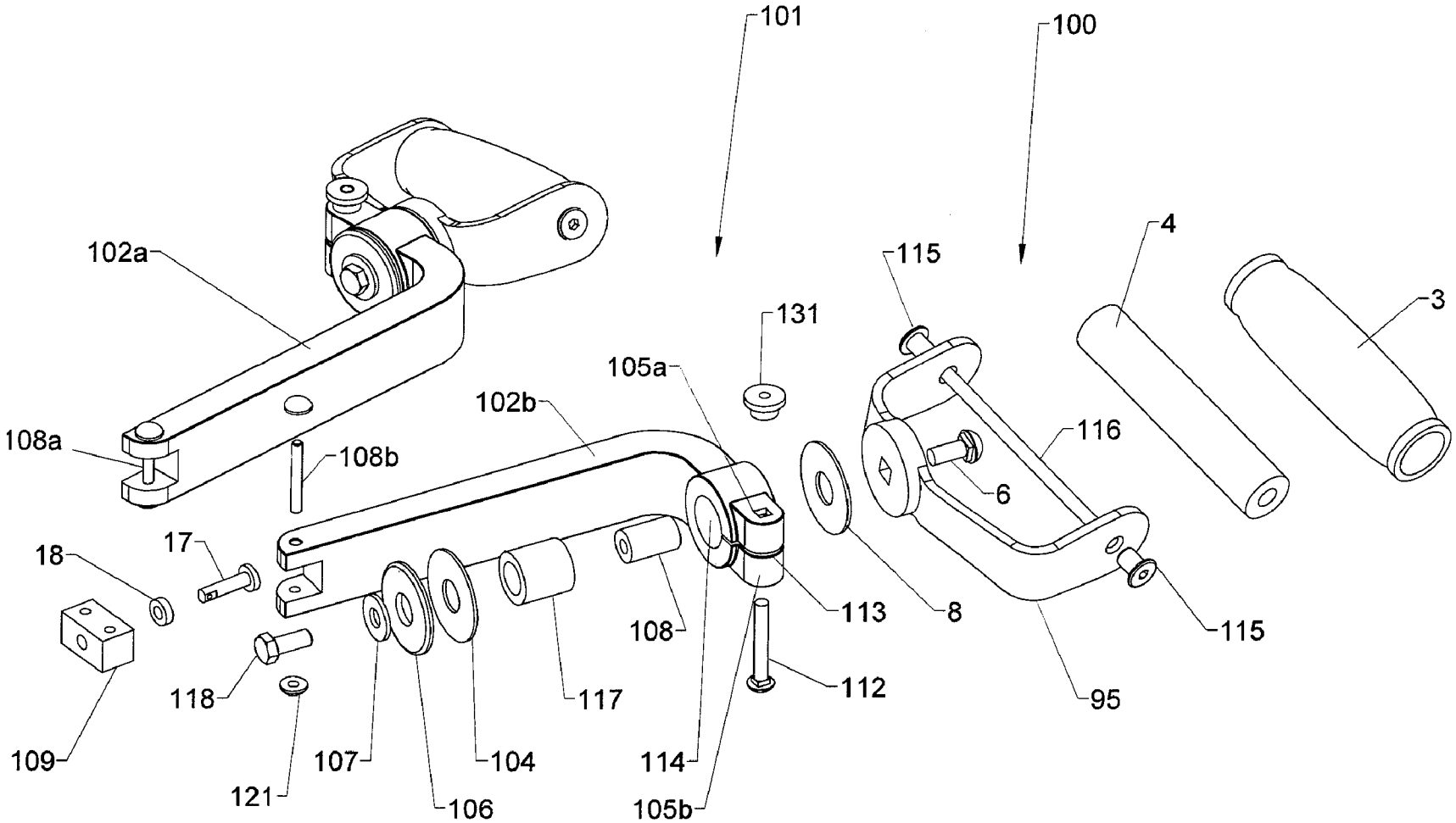
FIG. 19 is a partial exploded view of the device.

With reference to FIG. 19, the handle 101 includes the hand grip 100 made up of handgrip bracket 95 each comprised of a roller handgrip 3 surrounding a handgrip core 4, which are mounted on respective handgrip brackets 95 via threaded fasteners 115 and 116 extending through the handgrip brackets 95 and axially through the handgrip core 4. One of the handgrip brackets 95 is rotatably mounted to the outer free end of each of the first and second arms 102*a* and 102*b* via bracket connecting bolt 6, and low friction washer 8, so that the handgrip bracket 5 can rotate about and axis perpendicular to the handgrip 3 enabling the users wrists to rotate during the pushing and pulling of the rowing motion.

A steel cylinder 103 has a threaded hole passing therethrough to accept the handgrip bracket connecting bolt 6 from one side and cap bolt 118 from the other side. Preferably, the connecting bolt 6 is a carriage bolt style, which fits into a mating square hole in handgrip bracket 95, ensuring that the handgrip 100, connecting bolt 6, and cylinder 103, rotate together as one unit.

Each adjustable friction clutch mechanisms 110*a* and 110*b* also includes a hole 114 extending therethrough, which is sized to enable a close, but freely rotating, fit of a roller clutch 117 within the hole 114 and around the steel cylinder 103. A bolt 112, which carries the adjustment knobs 111*a* or 111*b*, extends through adjacent ears 105*a* and 105*b* and bridges slot 113, therebetween, to enable the diameter of the hole 114 to be increased or decreased by tightening or loosening the knob 111*a* or 111*b*. Thus, tightening the knob 111*a* or 111*b* results in the inner surface of hole 114 to come into contact with the outer circumferential surface of roller clutch 117, thereby causing frictional resistance to rotation of the roller clutch 117 within the hole 114. The tighter the knob 111*a* or 111*b*, the greater the resistance to rotation of the roller clutch 117 within the hole 114.

If the handgrip 100 is rotated counterclockwise (as occurs during the return portion of a sculling stroke) the cylinder 103 will rotate freely within the core of the roller clutch 117. If the handgrip 100 is rotated clockwise (as occurs during the power portion of a sculling stroke), the roller clutch 117 locks on to cylinder 103, causing the roller clutch 117 to rotate with cylinder 103. Thus, depending on the tightness of adjustment knob 111, there will be a corresponding resistance to rotation of the roller clutch 117 within the hole 114 and a resistance to clockwise rotation of the handgrip 100.

Low friction washers 8 and 104 facilitate smooth rotation of the handgrip 100 about a horizontal axis defined by the bolts 6 and 118. The steel cylinder 103 is sized in length so that when handgrip connecting bolt 6 and cap bolt 118 are tightened securely therein, free rotation of the handgrip 100 is not impaired.

A lock washer 107 is provided between the cap bolt 118 and the cap washer 106 to prevent the cap bolt 118 from loosening during use. Also, in this regard, since resistance to rotation of handgrip 100 is in the clockwise direction during the crossover (sculling style) rowing exercise, that resistance will tend to tighten, rather than loosen, bolt 118 and bolt 6, adding to the security of the assembly.

At their forward ends, the handle arms 102*a* and 102*b* are secured to a pivot pin block 109 by pivot pins 108*a* and 108*b* and caps 121, which enables independent rotation of each handle arm 102*a* and 102*b* about a vertical axis defined the pivot pins 108*a* and 108*b*, respectively. The pivot pin block 109 also houses chain connecting pin 17 and thrust bearing 18.

The adjustable resistance to clockwise handgrip rotation enables the user to control the rate of progression from a crossover hand position to a horizontal hand position by tightening or loosening knob 111. Since uni-directional resistance to handgrip rotation is only required when exercising using the sculling (crossover) rowing style, if the user wishes to exercise using other (non-crossover) rowing styles, loosening knob 111 removes all resistance to handgrip rotation. In this loosened knob mode, the handle 101 is functionally identical to the handle 91.

Providing only one of the friction clutch mechanism 110*a* or 110*b* to one of the handle arms 102*a* or 102*b* still results in a significant improvement in the functional characteristics of the handle, i.e. enables user control of the rate of progression from a crossover to horizontal position of the hands when exercising using the sculling style of rowing stroke, in comparison to the use of the handles 1, 71, and 91. The improvement obtained by addition of the second friction clutch mechanism 102 is not as dramatic as the improvement obtained by addition of the first friction clutch mechanism 102*b*, but the improvement is significant enough that the addition of two such mechanisms is the preferred embodiment.

The conventional hand position of sculling is left hand over right hand, and the handle 101 is, as described, designed to accommodate that hand position. If the user wishes to use an unconventional right over left hand crossover style, the handle 101 could easily be altered to accommodate this. If, during assembly, the roller clutch 117 were to be reversed end to end, the described resistance to rotation would then be in the opposite direction and the functional characteristics would then meet the requirements of a right hand over left hand rowing style.

Figure 20A:
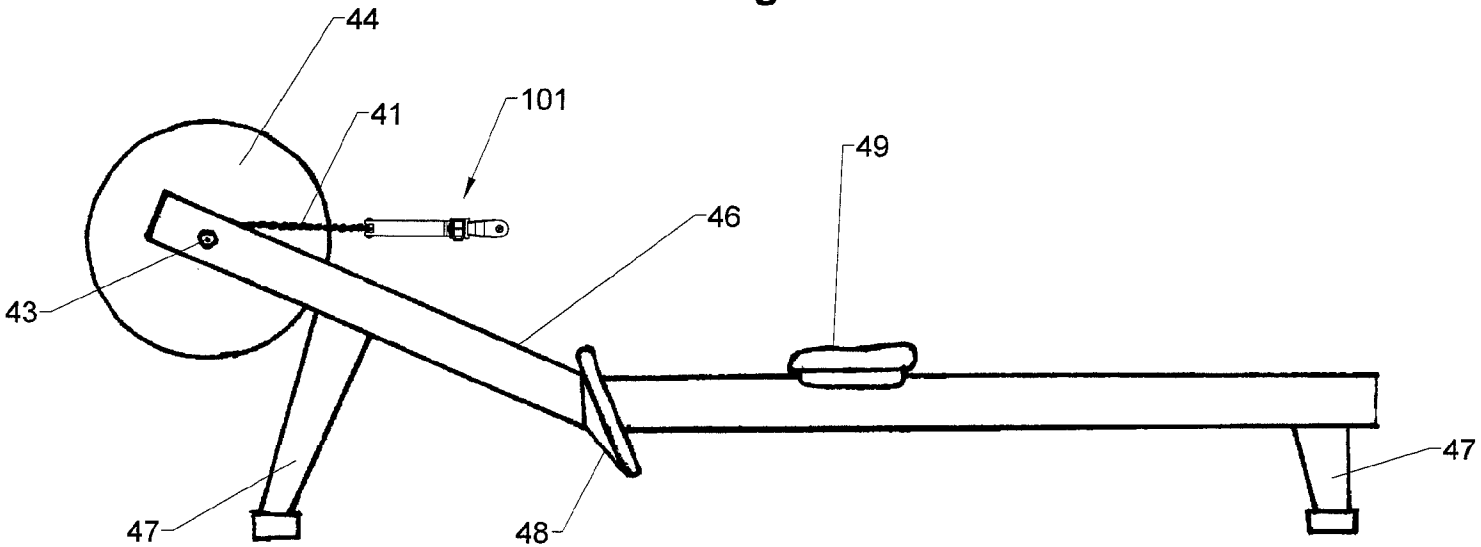
FIG. 20*a* is a side view of the device connected to a rowing machine.
Figure 20B:
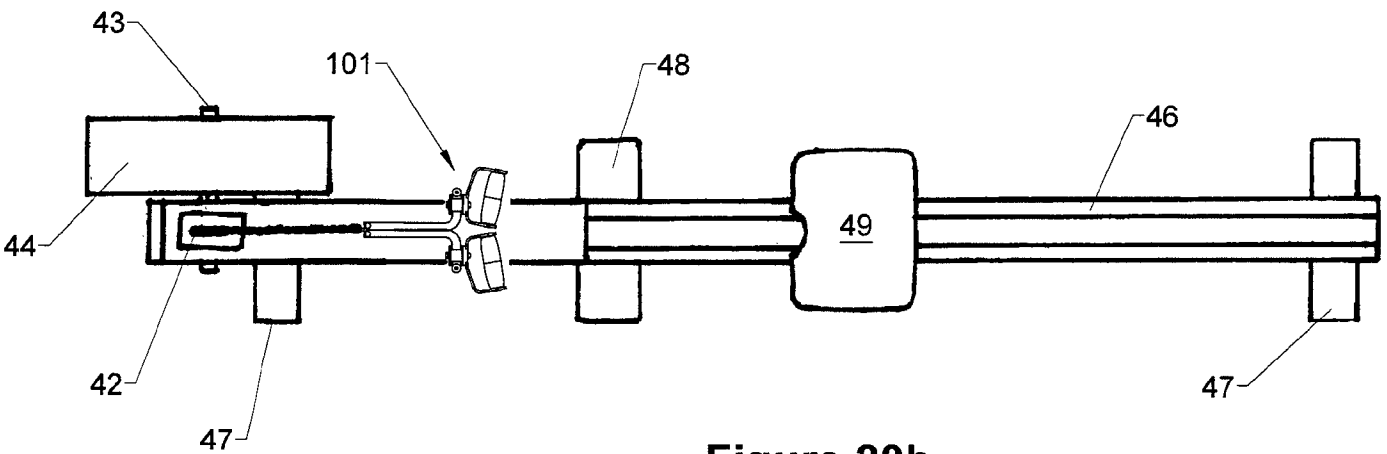
FIG. 20*b* is a top view of the device connected to a rowing machine.

FIGS. 20*a* and 20*b*, similar to FIGS. 8*a* and 8*b*, illustrate the handle 101 on the rowing machine. As above, the handle 101 is connected to the end of the connector 41, which engages the sprocket 42 mounted on the shaft 43 extending from the flywheel or other resistive device 44. The flywheel 44 is mounted on the frame 46, which includes ground engaging legs 47, foot rests 48, and sliding seat 49, whereby the user can reciprocate backward on the frame 46, while pulling on the connector 41 via the handle 101, and reciprocate forward on the frame 46, while the connector 41 is returned to the rest position by means of a suitable spring mechanism.

Figure 21A:
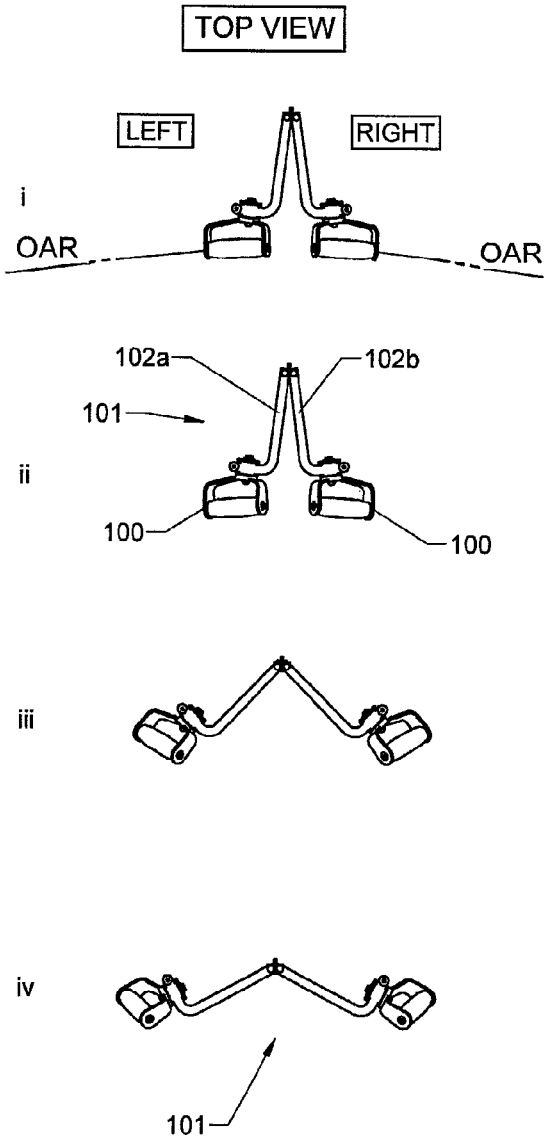
FIGS. 21*a* and 21*b* illustrate in sequenced images the positional changes of the handgrips and arms of the device when the user exercises using a standard (no crossover) style of rowing stroke.
Figure 21B:
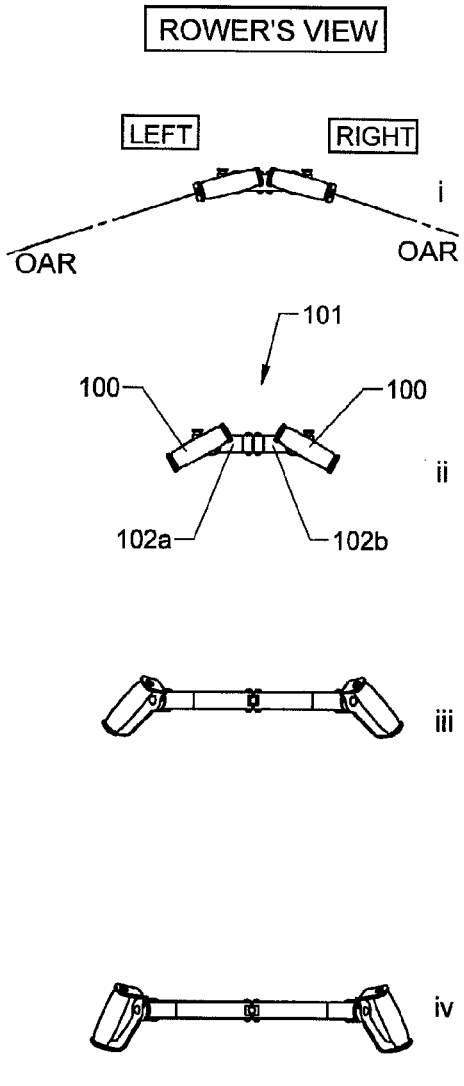
Figure 22A:
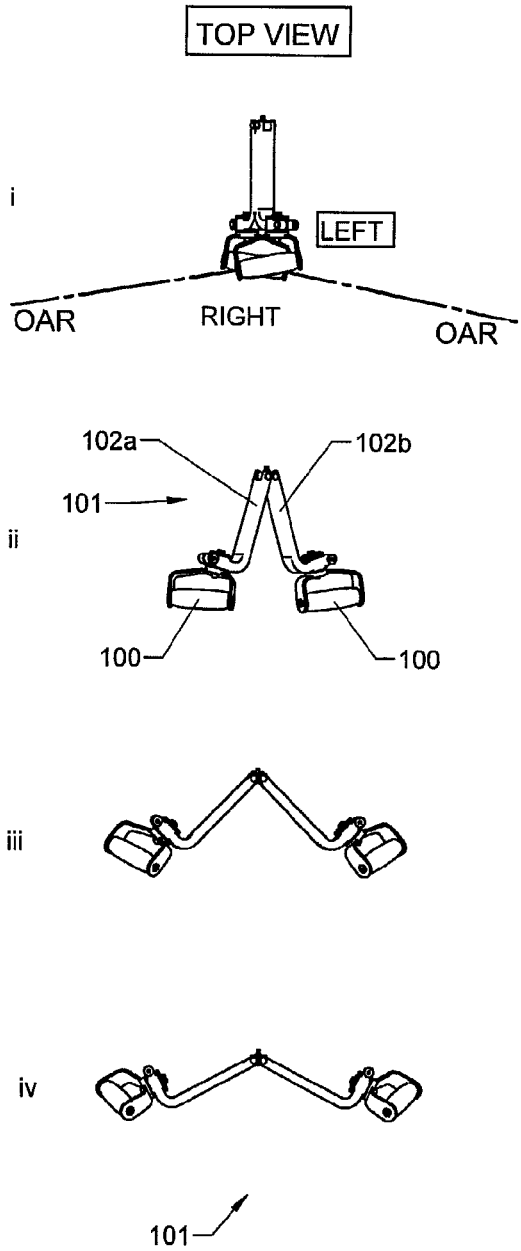
Figure 22A:
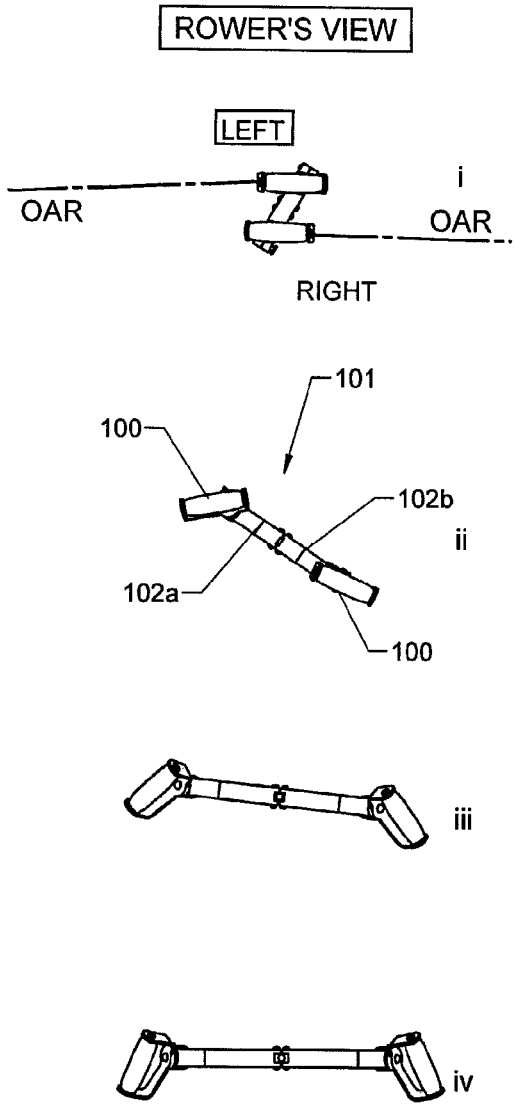

FIGS. 21*a* and 21*b* illustrate the illustrate handgrips 100 and arms 102*a* and 102*b* (or 92*a* and 92*b*) positions throughout the rowing stroke in the standard configuration, while FIGS. 22*a* and 22*b* illustrate handgrips 100 and arm 102*a* and 102*b* (or 92*a* and 92*b*) positions throughout the rowing stroke in the crossover configuration. Note that at the beginning of the stroke, i.e. FIG. 21*b* (*i*) the user's hands, gripping the handgrips 95, are held at an acute angle to the horizontal that closely matches the angle of the hands gripping oars at the beginning of an actual rowing stroke, and also closely matching the natural angle of the human grip, i.e. the angle of a normal grip formed with the arm outstretched. The ergonomically correct relationship of grip to forearm position is maintained throughout the stroke. As the rowing stroke progresses, the pulling on the handles 101 by the user will cause each arm 102*a* and 102*b* to rotate about the pivot pins 108*a* and 108*b*, respectively, thereby causing the handgrip angle to change, i.e. FIG. 21*b* (*iii*), closely replicating the changing angle of the hands during actual rowing, and ensuring that the user's hands, wrists, and forearms remain comfortably aligned with the direction of the applied force. The alignment overcomes the primary deficiency and source of discomfort in using the rigid, single piece handle commonly utilized on rowing exercise devices in which the angle between the handgrip and the user's wrists and forearms changes dramatically throughout the stroke, stressing these joints.

For the crossover configuration, illustrated in FIGS. 22*a* and 22*b*, the handle 101 (or 91) is rotated about the horizontal axis defined by the connecting pin 17, so that the arms 102*a* and 102*b* are vertically stacked, i.e. superposed, with the handgrips 100 separated vertically 22*b* (*i*). As the stroke progresses, the arms 102*a* and 102*b* (or 92*a* and 92*b*) are rotated about the pivot pins 108*a* and 108*b*, as well as the connecting pin 17, whereby in the middle of the stroke (FIG. 22*b*(*ii*) and 22*b*(*iii*)) the arms 102*a* and 102*b* (or 92*a* and 92*b*) are at an acute angle to the horizontal. At the end of the stroke (FIG. 22*b*(*iv*)) the arms 102*a* and 102 (or 92*a* and 92*b*) are again horizontal.

I claim:

1. A handle for mounting on an end of a connector, which extends along an axis of force application in a rowing exercise machine, comprising:

a mounting bracket rotatable about the axis of force application for connecting to the one end of the connector;

a first arm structure pivotally connected at one end to the mounting bracket;

a second arm structure pivotally connected at one end to the mounting bracket;

a first handgrip mounted on an outer free end of the first arm structure; and a second handgrip mounted on an outer free end of the second arm structure;

whereby the outer free ends of the first and second arms are rotatable relative to the axis of force application and the mounting bracket from a superposed, vertically-stacked position to a spaced apart horizontal position as force is applied along the axis of force application;

wherein the first and second arm structures are mounted on the mounted bracket for rotation relative to the mounting bracket only about the same or parallel axes, whereby the first and second arm structures rotate relative to the mounting bracket in a same or parallel planes, which rotates around the axis of force application.

2. The handle according to claim 1, further comprising:

a first handgrip locking bracket for mounting the first handgrip on the outer free end of the first arm structure, and locking the first handgrip in a first and a second position;

a second handgrip locking bracket for mounting the second handgrip on the outer free end of the second arm structure, and locking the second handgrip in a first and a second position;

wherein the first and second handgrip locking brackets are pivotable from the first position in which the first and second handgrips are alignable horizontally to the second position in which the first and second handgrips are alignable vertically.

3. The handle according to claim 2, wherein the first and second handgrips are pivotally mounted about a generally horizontal axis to the first and second handgrip locking brackets, respectively, enabling the first and second handgrips to rotate during use.

4. The handle according to claim 1, further comprising a pivot pin extending through the mounting bracket and the ends of the first and second arm structures; wherein the first and second arms rotate in different parallel planes.

5. The handle according to claim 1, wherein the first and second arm structures are mounted on the mounted bracket via one pivot pin or a pair of parallel pivot pins.

6. The handle according to claim 1, wherein the first arm structure includes:

a first linkage arm pivotally connected at one end to the mounting bracket;

a supporting bracket; and a first L-shaped arm pivotally connected at a first end to the mounting bracket, and at a second end to another end of the first linkage;

wherein the first handgrip is mounted on the end of the first L-shaped arm.

7. The handle according to claim 1, wherein each of the first and second arm structures comprises an elongated section pivotally connected to and extending from the mounting bracket, and a shorter section extending from the ends of the elongated section; and wherein the shorter sections extend away from each other.

8. The handle according to claim 7, wherein the shorter section is perpendicular to the elongated section.

9. The handle according to claim 1, further comprising first and second handgrip rotating brackets for mounting on the ends of the first and second arm structures, respectively, for supporting the first and second handgrips, respectively;

wherein each of the first and second handgrip rotating brackets are pivotally mounted about a generally horizontal axis to the outer free ends of the first and second arm structures, respectively, enabling the first and second handgrips to rotate during use.

10. The handle according to claim 9, wherein the first handgrip is connected to the first handgrip rotating bracket at an acute angle to the horizontal axis about which the first handgrip rotating bracket rotates.

11. The handle according to claim 9, further comprising a friction clutch for providing resistance to the rotation of the first handgrip rotating bracket.

12. The handle according to claim 11, wherein the friction clutch comprises an adjustable friction clutch for providing a selectable amount of friction.

13. The handle according to claim 11, wherein the friction clutch comprises a uni-directional friction clutch providing negligible resistance to rotation of the first handgrip in one direction.

14. An exercise device comprising:

a frame;

a seat for supporting a user, slideable on the frame;

a flywheel mounted on the frame including connector extending therefrom; and the handle, according to claim 1, connected to the end of the connector.

* * * * *